US012241342B2

(12) United States Patent
Sullivan

(10) Patent No.: US 12,241,342 B2
(45) Date of Patent: Mar. 4, 2025

(54) PERFORATING GUN ASSEMBLY HAVING DETONATOR INTERRUPTER

(71) Applicant: XConnect, LLC, Denver, CO (US)

(72) Inventor: Shelby L. Sullivan, Minot, ND (US)

(73) Assignee: XConnect, LLC, Denver, CO (US)

( * ) Notice: Subject to any disclaimer, the term of this patent is extended or adjusted under 35 U.S.C. 154(b) by 208 days.

(21) Appl. No.: 18/301,107

(22) Filed: Apr. 14, 2023

(65) Prior Publication Data

US 2023/0250710 A1 Aug. 10, 2023

Related U.S. Application Data

(63) Continuation-in-part of application No. 17/547,016, filed on Dec. 9, 2021, now Pat. No. 11,906,278, and a continuation-in-part of application No. 17/547,053, filed on Dec. 9, 2021, now Pat. No. 11,940,261, and a continuation-in-part of application No. 17/175,651, filed on Feb. 13, 2021, now Pat. No. 11,293,737.

(60) Provisional application No. 63/481,419, filed on Jan. 25, 2023, provisional application No. 63/340,123, filed on May 10, 2022.

(51) Int. Cl.
*E21B 43/1185* (2006.01)

(52) U.S. Cl.
CPC ..... *E21B 43/1185* (2013.01)

(58) Field of Classification Search
None
See application file for complete search history.

(56) References Cited

U.S. PATENT DOCUMENTS

| | | | |
|---|---|---|---|
| 2,655,993 | A | 1/1948 | Lloyd |
| 3,739,724 | A | 7/1973 | Tlam |
| 3,878,786 | A | 4/1975 | Ridgeway |
| 4,011,815 | A | 3/1977 | Garcia |
| 4,292,895 | A | 10/1981 | Bell et al. |
| 4,314,614 | A | 2/1982 | McPhee et al. |
| 4,523,650 | A | 6/1985 | Sehnert et al. |
| 4,561,356 | A | 12/1985 | Bordon et al. |
| 4,649,822 | A | 3/1987 | Seeman et al. |
| 4,765,409 | A | 8/1988 | McClure et al. |
| 4,967,048 | A | 10/1990 | Langston |

(Continued)

*Primary Examiner* — Reginald S Tillman, Jr.
(74) *Attorney, Agent, or Firm* — Peter L. Brewer; Thrive IP

(57) ABSTRACT

A detonator interrupter assembly is provided. The detonator interrupter assembly is designed to inhibit the arming of a detonator within the charge tube of a perforating gun assembly. The detonator interrupter assembly first includes a top end plate. The top end plate is configured to reside between charge tubes. The top end plate has a flange intermediate first and second ends. The detonator interrupter assembly also includes a detonator clip. The detonator clip resides proximate the second end of the top end plate. The detonator clip comprises a first slot configured to receive a detonator cord, and a second slot configured to receive a detonator tube which contains an explosive material. The detonator interrupter assembly also includes an interrupter. The interrupter comprises a handle portion and an opposing blade portion. The blade portion is configured to pass through a through-opening through the flange when an operator removes the interrupter from between the first and second slots. The blade portion is fabricated from an impact resistant material.

20 Claims, 16 Drawing Sheets

(56) References Cited

U.S. PATENT DOCUMENTS

| | | | | |
|---|---|---|---|---|
| 5,027,708 | A | 7/1991 | Gonzalez et al. | |
| 5,070,788 | A | 12/1991 | Carisella et al. | |
| 5,155,293 | A | 10/1992 | Barton | |
| 5,159,145 | A | 10/1992 | Carisella et al. | |
| 5,159,146 | A | 10/1992 | Carisella et al. | |
| 5,165,489 | A | 11/1992 | Langston | |
| 5,881,152 | A | 3/1999 | Moos | |
| 6,397,752 | B1 | 6/2002 | Yang et al. | |
| 7,387,156 | B2 | 6/2008 | Drummond et al. | |
| 8,596,378 | B2 | 12/2013 | Mason et al. | |
| 9,982,979 | B2 | 5/2018 | Graswald | |
| 11,293,737 | B2 | 4/2022 | Sullivan et al. | |
| 11,460,281 | B2 | 10/2022 | LeClair et al. | |
| 11,629,579 | B2 | 4/2023 | Davis et al. | |
| 11,814,934 | B2 * | 11/2023 | Wells | E21B 47/04 |
| 2014/0231065 | A1 * | 8/2014 | Mason | E21B 43/11855 166/55.2 |
| 2015/0226532 | A1 | 8/2015 | Morrison et al. | |
| 2020/0199982 | A1 * | 6/2020 | Quattlebaum | E21B 43/1185 |

* cited by examiner

PERFORATING GUN ASSEMBLY HAVING DETONATOR INTERRUPTER

STATEMENT OF RELATED APPLICATIONS

The present application claims the benefit of U.S. Ser. No. 63/481,419 filed on Jan. 25, 2023. That application is entitled "Perforating Gun Assembly Having Detonator Interrupter."

The present application also claims the benefit of U.S. Ser. No. 63/340,123 filed on May 10, 2022. That application is entitled "Perforating Gun Assembly Having Detonator Interrupter."

This application is also filed as a Continuation-in-Part of U.S. Ser. No. 17/547,016 (1312.0014-US1). That application was filed on filed Dec. 9, 2021 and is entitled "Bridged Bulkheads For a Perforating Gun Assembly."

This application is also filed as a Continuation-in-Part of U.S. Ser. No. 17/547,053 (1312.0014-US2). That application was filed on filed Dec. 9, 2021 and is entitled "Bulkhead For a Perforating Gun Assembly."

The '053 patent was filed as a Continuation-in-Part of U.S. Ser. No. 17/175,651 (1312.0007-US3). That application was filed on filed Feb. 13, 2021 and is entitled "Detonation System Having Sealed Explosive Initiation Assembly."

Each of these applications is incorporated herein in its entirety by reference.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

Technical Field of the Invention

The present disclosure relates to the field of hydrocarbon recovery operations. More specifically, the invention relates to a perforating gun assembly used for the perforation of steel casing in a wellbore. Further still, the present disclosure relates to an end plate assembly for a perforating gun assembly, wherein the end plate receives a sliding detonator interrupter.

Discussion of the Background

For purposes of this disclosure, pending U.S. Ser. No. 17/175,651 will be referred to as "the parent application."

In the drilling of an oil and gas well, a near-vertical wellbore is formed through the earth using a drill bit urged downwardly at a lower end of a drill string. After drilling to a predetermined depth, the drill string and bit are removed and the wellbore is lined with a string of casing. An annular area is thus formed between the string of casing and the formation penetrated by the wellbore.

A cementing operation is conducted in order to fill or "squeeze" the annular volume with cement along part or all of the length of the wellbore. The combination of cement and casing strengthens the wellbore and facilitates the zonal isolation, and subsequent completion, of hydrocarbon-producing pay zones behind the casing.

In connection with the completion of the wellbore, several strings of casing having progressively smaller outer diameters will be cemented into the wellbore. These will include a string of surface casing, one or more strings of intermediate casing, and finally a string of production casing. The process of drilling and then cementing progressively smaller strings of casing is repeated until the well has reached total depth. In some instances, the final string of casing is a liner, that is, a string of casing that is not tied back to the surface.

Within the last two decades, advances in drilling technology have enabled oil and gas operators to "kick-off" and steer wellbore trajectories from a vertical orientation to a near-horizontal orientation. The horizontal "leg" of each of these wellbores now often exceeds a length of one mile, and sometimes two or even three miles. This significantly multiplies the wellbore exposure to a target hydrocarbon-bearing formation. The horizontal leg will typically include the production casing.

The horizontal leg of the wellbore includes a heel and a toe. In order to enhance the recovery of hydrocarbons, particularly in low-permeability formations, the casing along the horizontal section undergoes a process of perforating and fracturing (or in some cases perforating and acidizing). Due to the very long lengths of new horizontal wells, the perforating and formation treatment process is typically carried out in stages.

In one method, a perforating gun assembly is pumped down towards the end of the horizontal leg at the end of a wireline. FIG. 1 is a side view of an illustrative perforating gun assembly 100, or at least a portion of an assembly. The perforating gun assembly 100 comprises a string of individual perforating guns 110. The perforating guns are run into a wellbore at the end of a wireline 140. Each gun has sets of charges ready for detonation.

The charges associated with one of the perforating guns are detonated and perforations are "shot" into the surrounding casing (not shown). Those of ordinary skill in the art will understand that a perforating gun has explosive charges, typically shaped, hollow, or projectile charges, which are ignited to create holes in the casing (and, if present, the surrounding cement) and to pass at least a few inches and possibly several feet into the formation. The perforations create fluid communication with the surrounding formation (or pay zone) so that hydrocarbon fluids can flow into the casing.

After perforating, the operator will fracture (or otherwise stimulate) the formation through the perforations (not shown). This is done by pumping treatment fluids into the formation at a pressure above a formation parting pressure. After the fracturing operation is complete, the wireline 140 will be partially spooled from the surface and the perforating gun assembly 100 will be positioned at a new location (or "depth") along the horizontal wellbore. A plug is set below the perforating gun assembly 100 using a setting tool, and new shots are fired in order to create a new set of perforations. Thereafter, treatment fluid is again pumped into the wellbore and into the formation. In this way, a second set (or "cluster") of fractures is formed away from the wellbore.

The process of setting a plug, perforating the casing, and fracturing the formation is repeated in multiple stages until the wellbore has been completed, that is, it is ready for production. A string of production tubing (not shown) is then placed in the wellbore to provide a conduit for production fluids to flow up to the surface.

In order to provide perforations for the multiple stages without having to pull the perforating gun assembly 100 after every detonation, the perforating gun assembly 100 employs multiple guns 110 in series. Each perforating gun 110 represents various components. These typically include a "gun barrel" 112 which serves as an outer tubular housing. An uppermost gun barrel 112 is supported by the electric wireline (or "e-line") 140 that extends from the surface and delivers electrical energy down to the perforating gun assembly 100. Each perforating gun 110 also includes an explosive initiator, or "detonator" (shown in phantom at 129). The detonator 129 is typically a small aluminum housing having a resistor inside. The detonator 129 receives electrical energy from the surface and through the e-line 140, which heats the resistor.

The detonator 129 is surrounded by a sensitive explosive material such as RDX. When electrical current is run through the detonator 129, a small explosion is set off by the electrically heated resistor. Stated another way, the explosive compound is ignited by the detonator 129. This small explosion sets off an adjacent detonating cord (not shown). When ignited, the detonating cord initiates one or more shots, typically referred to as "shaped charges."

Illustrative shaped charges are shown at 320 in FIGS. 6B and 6C. The shaped charges are securely held within an inner tube (shown at 310 in FIGS. 2A, 2B, and 2C). Some refer to the inner tube 310 as a charge tube or a carrier tube. As the RDX is ignited, the detonating cord propagates an explosion down its length to each of the shaped charges 320 along the carrier tube 310. The shaped charges then discharge shots through openings 115 in the selected gun barrel 110.

The perforating gun assembly 100 may include short centralizer subs 120. The assembly 100 also includes the carrier tubes 310, which reside within the gun barrel housings 112 and are not visible in FIG. 1. In addition, tandem subs 125 are used to connect the gun barrel housings 112 end-to-end. Each tandem sub 125 comprises a metal threaded connector placed between the gun barrels 110. Typically, the gun barrels 110 will have female-by-female threaded ends while the tandem sub 125 has opposing male threaded ends. (A tandem sub is seen more clearly at 700 in FIG. 7A.)

The perforating gun assembly 100, with its long string of gun barrels (the housings 112 of the perforating guns 110 and the carrier tubes 310), is carefully assembled at the surface and then lowered into the wellbore at the end of the e-line 140. The e-line 140 extends upward to a control interface (not shown) located at the surface. An insulated connection member 130 connects the e-line 140 to the uppermost perforating gun 110. Once the perforating gun assembly 100 is in place within a wellbore, an operator of the control interface sends electrical signals to the perforating gun assembly 100 for detonating the shaped charges 320 and for creating perforations in the casing.

After the casing has been perforated and at least one plug has been set, the setting tool and the perforating gun assembly 100 are taken out of the wellbore and a ball is dropped into the wellbore to close the plug. When the plug is closed, a fluid (e.g., water, water and sand, fracturing fluid, etc.) is pumped by a pumping system down the wellbore (typically through coiled tubing) for fracturing purposes. For a formation fracturing operation, the pump rate will create downhole pressure that is above the formation parting pressure.

As noted, the above operations may be repeated multiple times for perforating and/or fracturing the casing at multiple locations, corresponding to different stages of the well. Multiple plugs may be used for isolating the respective stages from each other during the formation fracturing stages. When all stages are completed, the plugs are drilled out and the wellbore is cleaned using a circulating tool.

A step in the wellbore perforating process is to threadedly connect the various gun barrels 110 using the tandem subs 125. As part of this process, the conductive wires running from gun-to-gun are connected. It can be appreciated that the transporting, handling, and running-in of the gun barrels 110 could create a hazard to field hands if the electrical connections were made at a location away from the well site (e.g., at a shop) and the perforating guns were armed. For this reason, the approved practice is to leave the individual perforating guns 110 in a safe or "disarmed" state until just before the perforating guns are assembled into a string and lowered into the wellbore. In many cases, service companies will wait until the parts are delivered to the well site before assembling the string itself. This means removing the charge tubes from the gun barrel housings and then connecting conductor wires.

Those of ordinary skill in the art will appreciate that well sites are not conducive to the manipulation and assembly of small components. In many instances, wells are drilled in remote locations and in harsh weather conditions, including extreme cold and/or wind. This makes the process of assembling and arming perforating guns at the well site a delicate and potentially hazardous operation. Accordingly, it is desirable to make the connections at the shop or field office and limit the electrical connections required to be made in the field.

Accordingly, a need exists for a perforating gun assembly that utilizes a sliding detonator interrupter that can be easily accessed by field technicians at the well site in order to arm a pre-assembled gun string. A need further exists for a detonation system wherein the detonator interrupter passes through an end plate that serves to isolate electronic components in each perforating gun from the pressure wave created during downstream detonation steps. A need further exists for such an end plate that supports a bulkhead and pre-wired signal contact pin.

SUMMARY OF THE INVENTION

A detonator interrupter assembly is first provided. The detonator interrupter assembly is designed to inhibit the ignition, or arming, of a detonator within the charge tube of a perforating gun assembly.

In one aspect, the detonator interrupter assembly first includes a top end plate. The top end plate is a steel plate configured to reside between charge tubes of the perforating gun assembly. The top end plate has a first end, a second end opposite the first end, and a flange intermediate the first and second ends. A through-opening extends through the flange.

The first end of the top end plate comprises a tubular opening. The tubular opening is configured to receive a contact pin for a perforating gun. The contact pin has a contact head at an upstream end.

The detonator interrupter assembly also includes a detonator clip. The detonator clip resides proximate the second (or downstream) end of the top end plate. The detonator clip comprises a first slot configured to receive a detonator cord, and a second adjacent slot configured to receive a detonator tube. The detonator tube contains an explosive material.

The detonator interrupter assembly also includes an elongated interrupter. The elongated interrupter comprises a handle portion at a first end, and a blade portion at a second end. The handle portion resides proximate the first (or upstream) end of the top end plate, while the blade portion resides proximate the second (or downstream) end of the top end plate.

In a preferred embodiment, the detonator clip is fabricated from a polymeric material. The first slot and the second slot are biased inwards towards each other. The blade portion is placed between the first slot and the second slot. The blade portion is fabricated from an impact resistant material (such as steel) to inhibit explosive impact between the detonator cord and the detonator while the blade portion remains between the first and second slots.

The blade portion is configured to pass through the through-opening extending through the flange. An operator will remove the interrupter from between the first slot and the second slot at the well site by pulling on the handle portion of the elongated interrupter.

In one aspect, the detonator clip comprises a pair of wings. A first wing resides adjacent the first slot, and a second wing resides adjacent the second slot. At the same time, the charge tube comprises a window. The first wing and second wing snap into opposing sides of the window.

In one arrangement, the first end of the top end plate comprises a tubular opening. The tubular opening is configured to receive a bulkhead. The bulkhead, in turn, receives a contact pin for a perforating gun. The contact pin has an upstream end and a downstream end. The upstream end of the contact pin extends into a tandem sub for a perforating gun. In this arrangement, the handle portion of the elongated interrupter is adjacent to and runs parallel with the bulkhead.

A method of arming a perforating gun assembly is also provided. In one aspect, the method first comprises providing a charge tube. The charge tube has at least one shaped charge. In addition, the charge tube holds a detonator containing an explosive material, and a detonator cord.

The method also includes providing a detonator clip. The detonator clip comprises a first slot holding a portion of the detonator cord, and a second slot adjacent to the first slot holding the detonator.

The method next includes abutting the charge tube against a top end plate. The top end plate comprises a first end, a second end opposite the first end, and a flange intermediate the first and second ends. In addition, the top end plate has a through-opening extending through a flange.

The method further comprises providing a detonator interrupter. The detonator interrupter is an elongated object that comprises a handle portion and a blade portion.

The method additionally includes sliding the blade portion of the detonator interrupter through the through-opening of the flange in the top end plate. The blade portion is further moved into a position between the first slot and the second slot. This serves to inhibit explosive transfer between the detonator and the detonator cord.

In the method, the first slot and the second slot are biased inwards towards each other. The blade portion is fabricated from an impact resistant material to inhibit explosive energy transfer between the detonator and the detonator cord while the blade portion remains between the first and second slots. In addition, the blade portion is configured to pass back through the through-opening extending through the flange when an operator removes the detonator interrupter from between the first slot and the second slot.

The charge tube and the detonator interrupter are part of a perforating gun assembly. Of course, the perforating gun assembly will include other components such as an addressable switch, a switch housing, and a detonator wire that places the detonator and the addressable switch in electrical communication.

The charge tube abuts the top end plate at the first (or upstream) end of the top end plate. The first end of the top end plate comprises a tubular opening that holds a contact pin. The method then further comprises placing the contact pin in the tubular opening. The contact pin is configured to transmit detonation signals from the surface to the perforating gun assembly.

In a preferred arrangement, the charge tube comprises a window. At the same time, the detonator clip comprises a pair of wings. The method comprises snapping the first wing into a first side of the window, and the second wing into a second side of the window, thereby securing the detonator clip adjacent the upstream end of the top end plate.

The method may further comprise:

placing a signal line in electrical communication with the contact pin;

placing the detonator in electrical communication with an addressable switch; and delivering the perforating gun assembly to a well site.

In addition, the method may further comprise:

after arrival at the well site, pulling the handle portion of the detonator interrupter from the through-opening of the top end plate, thereby withdrawing the blade portion from between the first slot and the second slot; and sliding an upstream gun barrel housing over the charge tube upstream from the top end plate.

In addition, the method may further comprise:

abutting a downstream charge tube to the top end plate at the second end;

sliding a downstream gun barrel housing over the downstream charge tube;

threadedly connecting the upstream and downstream gun barrel housings to respective opposing ends of a tandem sub, thereby forming the perforating gun assembly; and running the perforating gun assembly into a wellbore at the well site, at the end of an electric line, after the detonator interrupter has been withdrawn from the detonator clip.

The method may further comprise sending a detonation signal from a surface, into a wellbore, and down the electric line. The method also includes further sending the detonation signal through a perforating gun and through the signal transmission pin. From there, the method includes further sending the detonation signal to the addressable switch, wherein the addressable switch determines whether the detonation signal is addressed to the perforating gun. The addressable switch resides within a tandem sub below the perforating gun.

The method additionally comprises identifying that the detonation signal is addressed to the perforating gun. In response, the addressable switch sends a detonation signal to a detonator pin and back through the carrier end plate. The method then includes sending the detonation signal to a detonator to initiate explosive charges residing within the perforating gun. Note that the carrier end plate isolates the addressable switch from wellbore fluids and a pressure wave generated in response to the detonation of the explosive charges.

BRIEF DESCRIPTION OF THE DRAWINGS

So that the manner in which the present disclosure can be better understood, certain illustrations, charts, and/or flow charts are appended hereto. It is to be noted, however, that the drawings illustrate only selected embodiments of the inventions and are therefore not to be considered limiting of scope, for the present disclosure may admit to other equally effective embodiments and applications.

DEFINITIONS

Figure 1:
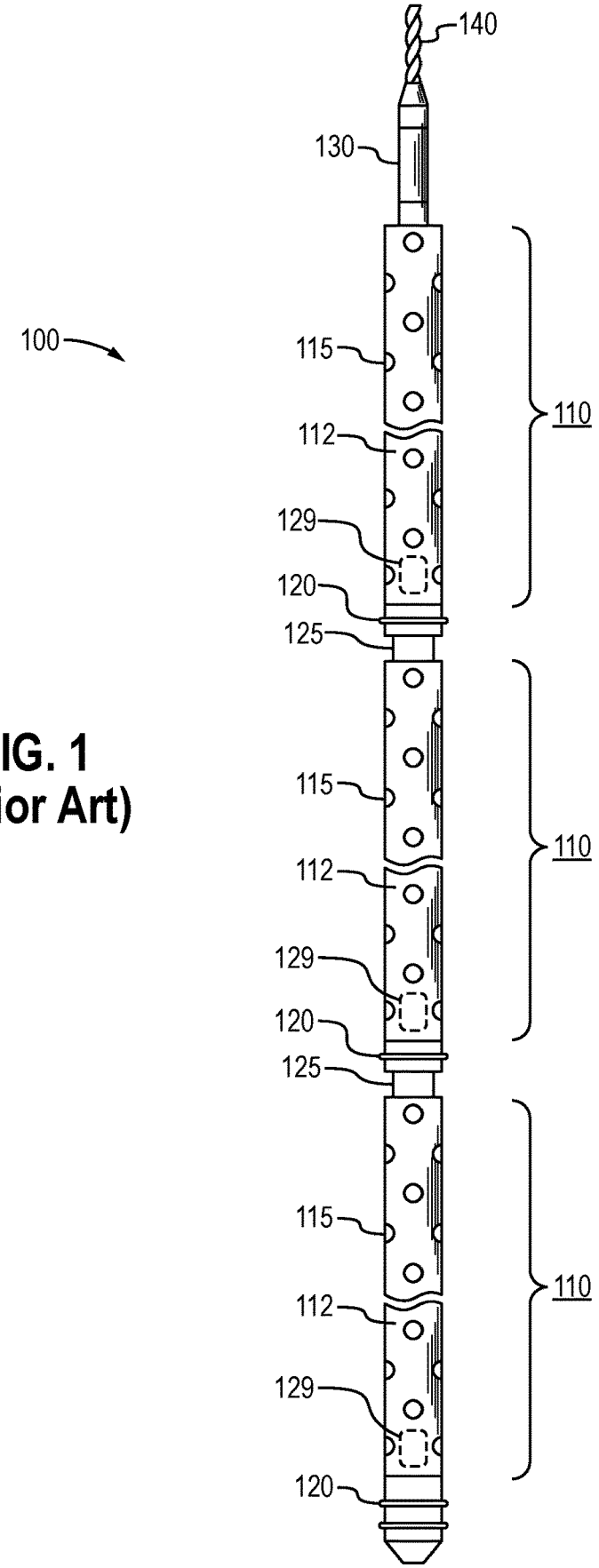
FIG. 1 (Prior Art)
FIG. 1 is a side view of a perforating gun assembly. The perforating gun assembly represents a series of perforating guns having been threadedly connected end-to-end. Tandem subs are shown between gun barrels of the perforating guns, providing the threaded connections.

For purposes of the present application, it will be understood that the term "hydrocarbon" refers to an organic compound that includes primarily, if not exclusively, the elements hydrogen and carbon. Hydrocarbons may also include other elements, such as, but not limited to, halogens, metallic elements, nitrogen, carbon dioxide, and/or sulfuric components such as hydrogen sulfide.

As used herein, the terms "produced fluids," "reservoir fluids" and "production fluids" refer to liquids and/or gases removed from a subsurface formation, including, for example, an organic-rich rock formation. Produced fluids may include both hydrocarbon fluids and non-hydrocarbon fluids. Production fluids may include, but are not limited to, oil, natural gas, pyrolyzed shale oil, synthesis gas, a pyrolysis product of coal, nitrogen, carbon dioxide, hydrogen sulfide, and water.

As used herein, the term "wellbore fluids" includes, produced fluids, but may also include drilling mud, fracturing fluids, or other fluids used in connection with the drilling and completion of a well.

As used herein, the term "fluid" refers to gases, liquids, and combinations of gases and liquids, as well as to combinations of gases and solids, combinations of liquids and solids, and combinations of gases, liquids, and solids.

As used herein, the term "subsurface" refers to geologic strata occurring below the earth's surface.

As used herein, the term "formation" refers to any definable subsurface region regardless of size. The formation may contain one or more hydrocarbon-containing layers, one or more non-hydrocarbon containing layers, an overburden, and/or an underburden of any geologic formation. A formation can refer to a single set of related geologic strata of a specific rock type, or to a set of geologic strata of different rock types that contribute to or are encountered in, for example, without limitation, (i) the creation, generation, and/or entrapment of hydrocarbons, and (ii) the execution of processes used to extract hydrocarbon fluids from the subsurface region.

As used herein, the term "wellbore" refers to a hole in the subsurface made by drilling or insertion of a conduit into the subsurface. A wellbore may have a substantially circular cross-section, or other cross-sectional shape. The term "well," when referring to an opening in the formation, may be used interchangeably with the term "wellbore."

Reference herein to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment.

DETAILED DESCRIPTION OF CERTAIN EMBODIMENTS

The following description of the embodiments refers to the accompanying drawings. The same reference numbers in different drawings identify the same or similar elements. The following detailed description does not limit the present disclosure; instead, the scope of the invention is defined by the appended claims.

The following embodiments are discussed, for simplicity, with regard to attaching two perforating guns to each other through a tandem sub. In the following, the terms "upstream" and "downstream" are being used to indicate that one gun barrel of a perforating gun may be situated above and one below, respectively, within a wellbore. However, one skilled in the art would understand that the present disclosure is not limited only to the upstream gun or only to the downstream gun, but in fact can be applied to either gun. In other words, the terms "upstream" and "downstream" are not necessarily used in a restrictive manner, but only to indicate, in a specific embodiment, the relative positions of perforating guns or other components.

Figure 2A:
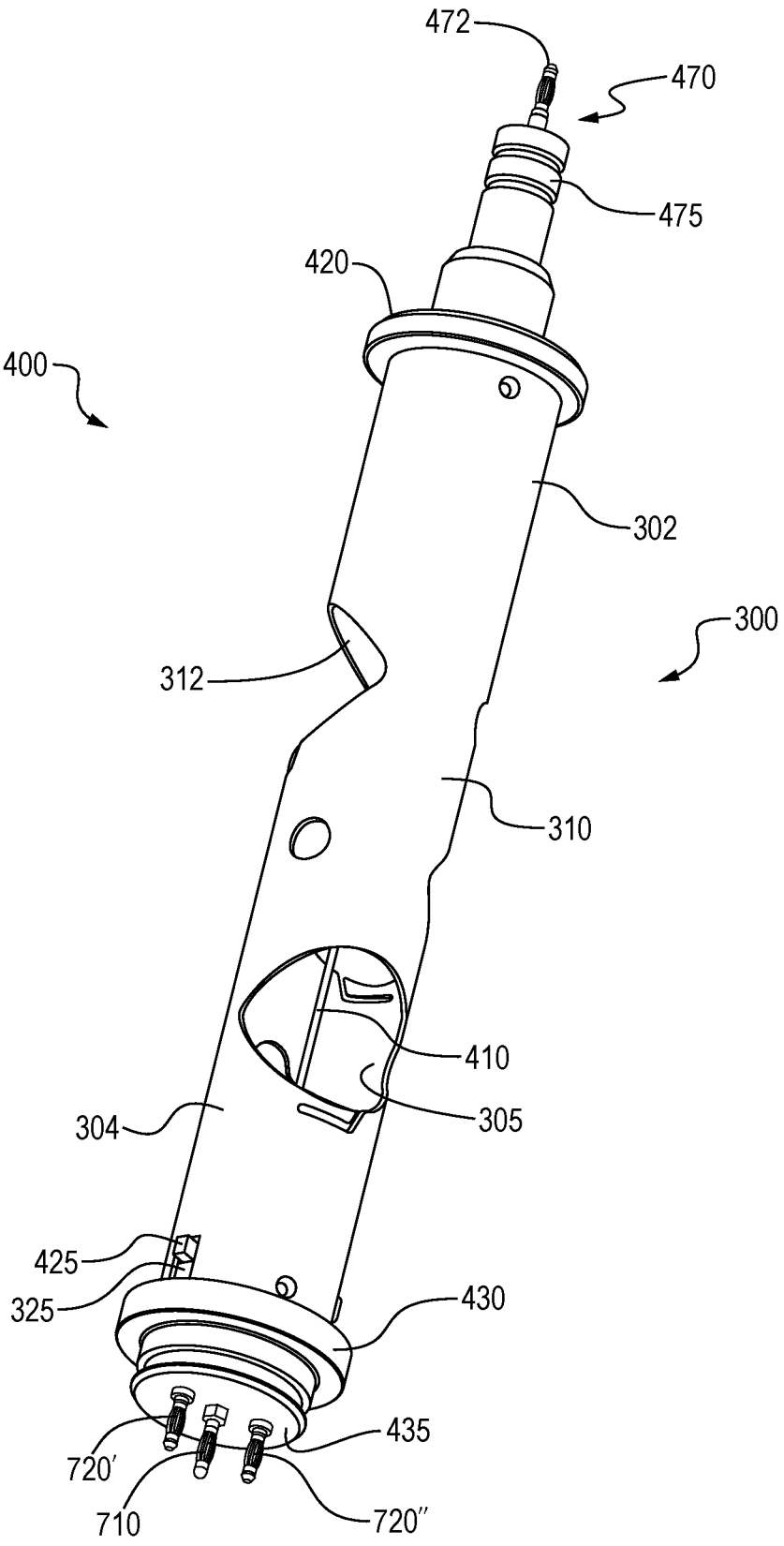
FIG. 2A is a perspective view of an illustrative charge tube (or carrier tube) for a perforating gun. The charge tube has received a top end plate and a bottom end plate. An electric line is shown extending through the charge tube and to the bottom end plate.

FIG. 2A is a perspective view of an illustrative carrier tube 300 for a perforating gun 110. The carrier tube 300 defines an elongated tubular body 310 having a first end 302 and a second end 304 opposite the first end 302. The tubular body 310 has an inner bore 305 dimensioned to receive charges (seen at 320 in FIGS. 6A through 6D, and elsewhere). Openings 312 are provided for receiving the charges 320 and enabling the charges 320 to penetrate a surrounding casing string (not shown) upon detonation.

A pair of end plates have been connected to opposing ends 302, 304 of the carrier tube 300, forming a part of a perforating gun assembly 400. These represent a top end plate 420 connected at end 302, and a bottom end plate 430 connected at the bottom end 304. The end plates 420, 430 have mechanically enclosed the top 302 and bottom 304 ends of the tubular body 310, respectively. Beneficially, the end plates 420, 430 help center the carrier tube 300 and its charges 320 within the outer gun barrel (shown at 510 in FIGS. 6A and 6B). For this reason, the end plates 420, 430 may be referred to as "carrier plates."

It is understood that each opening 312 along the carrier tube body 310 will receive and accommodate a separate shaped charge 320. Each shaped charge 320, in turn, is designed to detonate in response to an explosive signal passed through a detonating cord. An electronic detonator (shown at 229 in FIG. 8A) and a detonating cord (shown at 329 in FIGS. 6C and 7B) reside inside the carrier tube 300. The carrier tube 300 is intended to be illustrative of any standard carrier tube, so long as the gun provides a detonator and detonating cord internal to the carrier tube 300.

Extending up from the top end plate 420 is a bulkhead 475. The bulkhead 475 encloses a contact pin 470. The contact pin 470 is configured to transmit detonation and communication signals from the surface down to addressable switches (not shown) along the perforating gun string 100. The contact pin 470 and bulkhead 475 are shown in greater detail in FIGS. 4A and 4B, described below.

A signal transmission line 410 is seen extending down from the contact pin 470 and through the bore 305 of the elongated tubular body 310. The signal transmission line 410 connects to a signal transmission pin 720' that extends through the bottom end plate 430. A signal carried by the signal transmission line 410 is transmitted to a downstream perforating gun through the signal transmission pin 720' and a next signal transmission line 410.

The bottom end plate 430 has a closed end surface 435. Three pins are shown extending out of the closed end surface 435. These represent a ground pin 710 and two electrical pins 720', 720". In one aspect, the ground pin 710 connects to the bottom end plate 430 as an electrical ground, while electrical pins 720', 720" connect to white and green wires, respectively. Electrical pin 720' serves as a signal transmission pin while electrical pin 720" serves as a detonator pin.

Note that the ground pin 710 does not extend through the end plate 430 but simply extends from the end surface 435. In contrast, signal transmission pin 720' and detonator pin 720" do extend through the end plate 430. Preferably, signal transmission pin 720' and detonator pin 720" are part of bridged mini-bulkheads as described in U.S. Ser. No. 17/547,016 referenced above and referred to at 610 and 620. (See, e.g., FIGS. 6A and 6B of U.S. Ser. No. 17/547,016.)

Figure 2B:
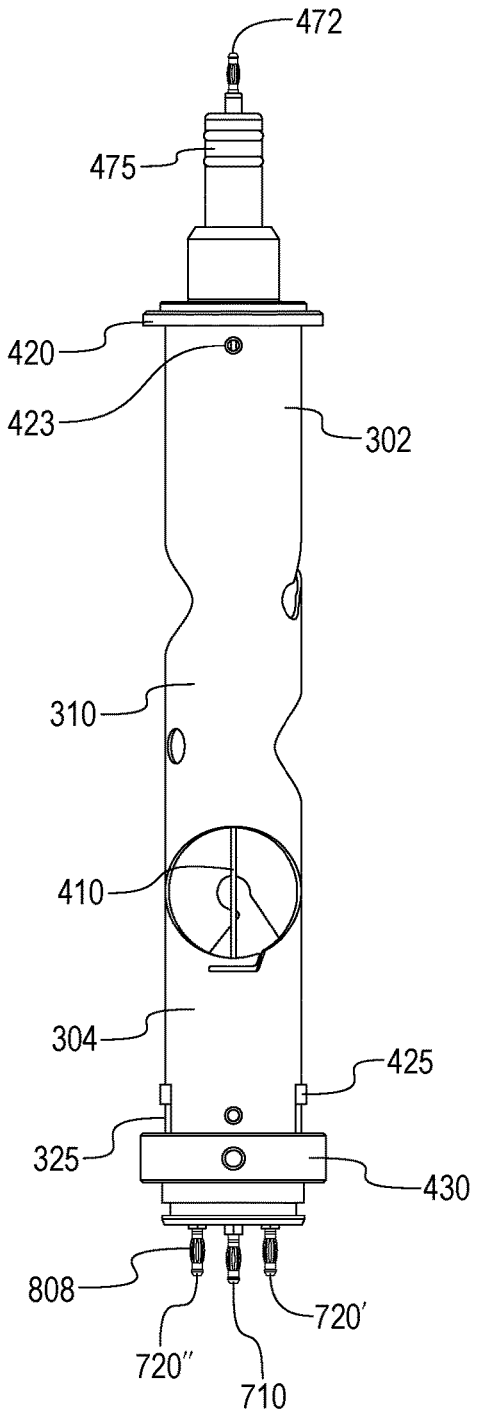
FIG. 2B is a first side view of the charge tube of FIG. 2A.
Figure 2C:
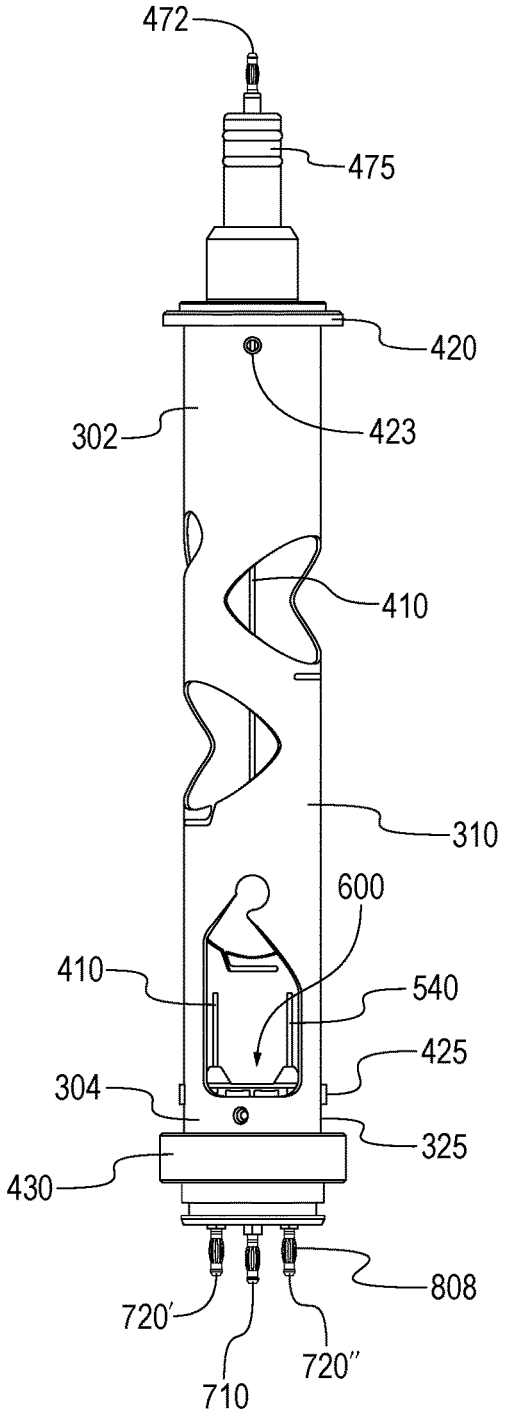
FIG. 2C is a second side view of the charge tube of FIG. 2A, wherein the charge tube has been partially rotated.

FIG. 2B is a first side view of the carrier tube 300 of FIG. 2A. FIG. 2C is a second side view of the carrier tube 300 of FIG. 2A, rotated 90° relative to the view of FIG. 2B. In each instance, the charges 320 have been removed, leaving the signal transmission line 410 visible. The signal transmission line 410 feeds into a first end of a bulkhead associated with (and securely connected to) a first end of the signal transmission pin 720'. In a similar way, a detonator wire 540 feeds into a first end of a bulkhead associated with (and securely connected to) a first end of the detonator pin 720".

Of interest, a second end of the signal transmission pin 720' extends out from the end surface 435 of the bottom end plate 430. Also, a second end of the detonator pin 720" extends out from the end surface 435 of the bottom end plate 430. Each of these second ends represents a banana clip 808 to facilitate an electrical connection.

Pins 720' and 720" reside within separate bulkheads. Because the pins 720' and 720" and their associated bulkheads are small (certainly smaller than bulkhead 475 of FIGS. 2A-2C), the bulkheads may be referred to as "mini-bulkheads." In U.S. Ser. No. 17/547,016, a unique "bridged" bulkhead assembly (shown at FIGS. 6A and 6B of U.S. Ser. No. 17/547,016) is provided. The bridged bulkhead assembly provides an efficient way to install pre-wired pins into the carrier end plate 430 for field-connection with the addressable switch (shown at 760 in the '016 parent application).

A portion of the bridged bulkhead assembly can be seen at 600 in FIG. 2C. The signal transmission line 410 extending from the bridged bulkhead assembly 600 feeds signals in a downstream direction. At the same time, wire 540 is an illustrative detonator wire, sending detonation signals from an addressable switch to a detonator in an upstream direction.

Preferably, the bottom end plate 430 includes compliant tabs. The tabs are seen partially at 425 in FIG. 2A. The compliant tabs 425 are configured to mate with slots 325 in the elongated tubular body 310 at end 304. This ensures a proper orientation of the pins 720', 720". Once the mini-bulkheads are installed, the compliant tabs 425 engage with slots 325, and the mini-bulkheads are unable to back out of the end plate 430. This removes the need for retainer nuts or other retention parts.

In the arrangement of FIGS. 2A through 2C, the tubular body 310 and associated gun barrel housing 112 are downstream from the contact pin 470. However, it is understood that a separate carrier tube and gun barrel housing reside upstream from the contact pin 470. Similarly, separate carrier tubes 310 and gun barrel housings 112 reside downstream from the pins 710, 720', 720", forming what may be a long series of perforating guns in a gun barrel string.

Figure 3A:
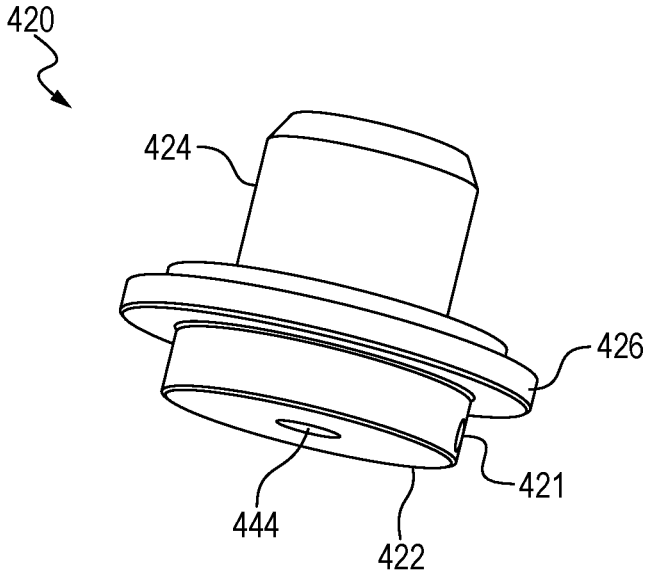
FIG. 3A is a perspective view of a top end plate that is part of a perforating gun assembly. The top end plate is designed to seat against an upstream end of the carrier tube of FIG. 2A.
Figure 10A:
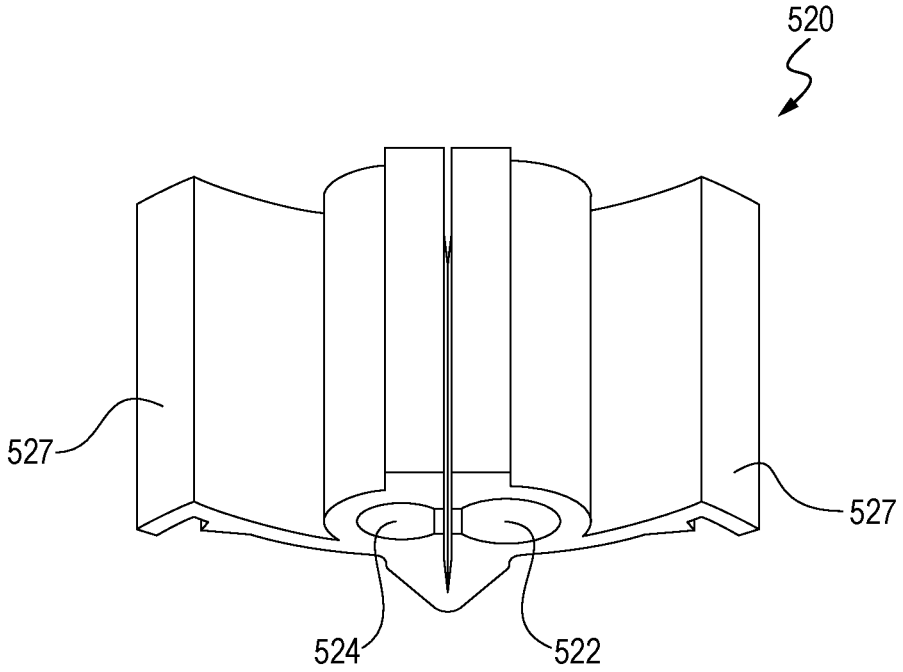
FIG. 10A is a first perspective view of a detonator clip as may be used with the detonator interrupter assembly of the present invention, in one embodiment.

FIG. 3A is a perspective view of the top end plate 420 of FIG. 2A, in one embodiment. The top end plate 420 has a proximal end 424 and a distal end 422. Intermediate the proximal 424 and distal 422 ends is a flange 426. The upstream end 302 of a charge tube 300 shoulders out against the downstream end of the flange 426. At the same time, and as shown in FIG. 10A of the parent application, the flange 426 receives the upstream end of a gun barrel housing.

The distal end 422 of the top end plate 420 comprises a threaded opening 421. The threaded opening 421 is configured to receive a bolt or pin (shown at 423 in FIGS. 2B and 2C). The pin 423 radially fixes the top end plate 420 to the top of the carrier tube 300.

Figure 3B:
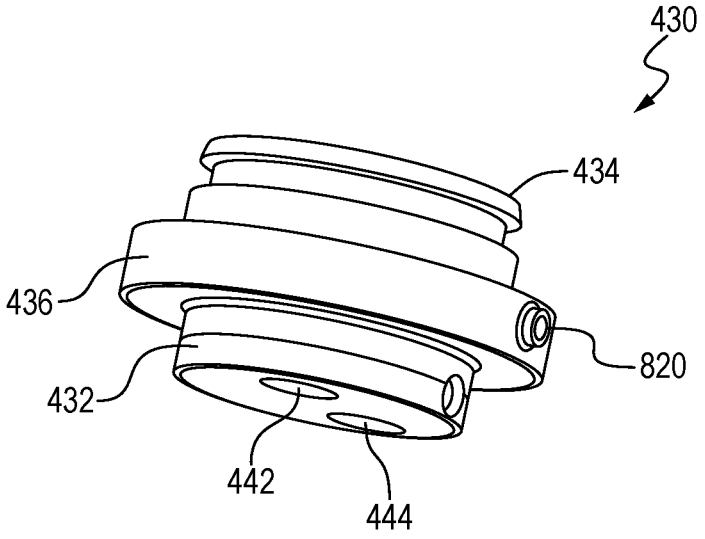
FIG. 3B is a perspective view of a bottom end plate that is part of the perforating gun assembly. The bottom end plate seats against a downstream end of the carrier tube of FIG. 2A.

FIG. 3B is a perspective view of the bottom end plate 430 that is part of the perforating gun assembly 400, in one embodiment. The bottom end plate 430 seats against the upstream end of the tandem sub 700 (seen in FIG. 7A). Note the radial shoulder 702 of the tandem sub 700 that serves as a stop member for opposing gun barrel housings 112. The bottom end plate 430 has a proximal end 432 and a distal end 434. Intermediate the proximal 432 and distal 434 ends is a flange 436.

At the proximal end 432 of the end plate 430 are two openings 442, 444. One of the openings 442 is dimensioned to receive the detonator pin 720" and the corresponding mini-bulkhead. The other opening 444 receives the signal transmission pin 720' and its own corresponding mini-bulkhead. As noted, the transmission pin 720' and the detonator pin 720" extend through the bottom end plate 430 and into a switch housing (shown at 750 in FIG. 10A of the parent application).

The bottom end plate 430 is slidably connected to the elongated tubular body 310 of the carrier tube 300 at end 304. A bolt (shown at 810 in FIG. 5A of the parent application) threadedly connects a proximal end 432 of the carrier end plate 430 to the lower end 304 of the carrier tube 300. At the same time, the flange 436 is received in the lowermost end of the gun barrel housing 510. The flange 436 also receives a bolt 820.

Flange members 436, 426 associated with the bottom end plate 430 and the top end plate 420, respectively, abut opposing ends of the tandem sub 700. Beneficially, the end plates 430, 420 mechanically seal the tandem sub 700, protecting the addressable switch from wellbore fluids and debris generated during detonation of the charges 320.

During assembly, the signal transmission line 410 is crimped to a bullet terminal, and the bullet terminal is then connected to the brass signal transmission pin 720'. Similarly, the detonator wire 540 is crimped to a bullet terminal, and the bullet terminal is then connected to the brass detonator pin 720". Over-molding then takes place. The result is that a seamless connection is created, and the "gun shop" is no longer required to connect the terminal and wire to the bulkhead or add insulator boots. This also provides a more secure connection between the components.

The signal transmission pin 720' transmits detonation signals through the end plate 430 in a first direction. At the same time, the detonator pin 720" transmits the detonation signals back up through the end plate 430 in a second direction opposite the first direction. Preferably, the first direction is downstream while the second direction is upstream.

Figure 4A:
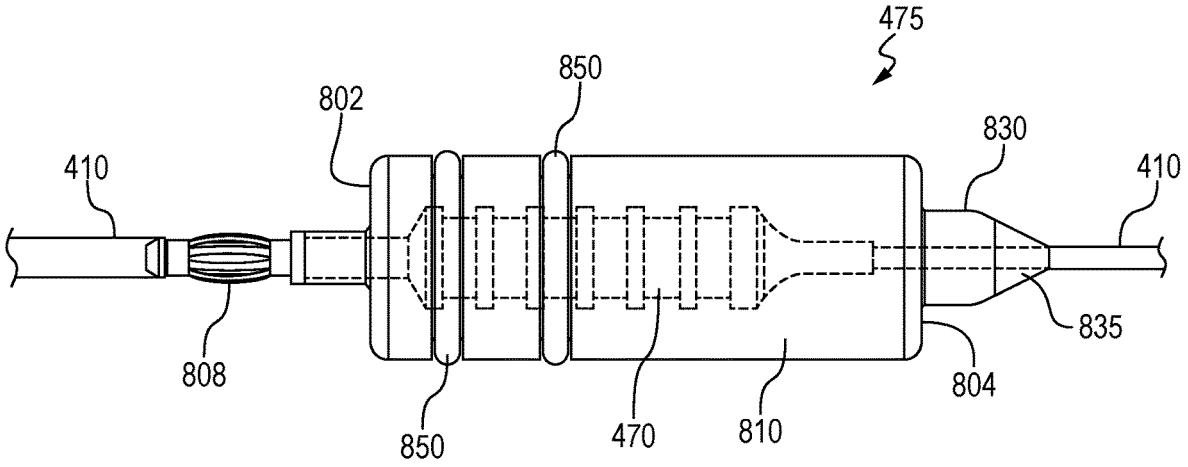
FIG. 4A is a cross-sectional view of a bulkhead that extends out from the carrier tube of FIG. 2A. The bulkhead closely holds a contact pin used to transmit detonation signals downstream.

FIG. 4A is a side, cross-sectional view of the bulkhead 475 of FIG. 2A. The contact pin 470 resides within the non-conductive bulkhead 475. The contact pin 470 is shown in phantom. A first (or proximal) end of the contact pin 470 extends into the switch housing of the assembly (shown at 750 in FIG. 6C), while a second (or distal) end of the contact pin 470 extends into the top end plate 420. The contact pin 470 is used to transmit signals through the tandem sub 700 down to a next perforating gun, while the bulkhead 475 provides electrical insulation between the conductive contact pin 470 and the surrounding metal tandem sub 700. In a preferred embodiment, the contact pin 470 comprises an electrically conductive material, for example, brass.

Figure 4B:
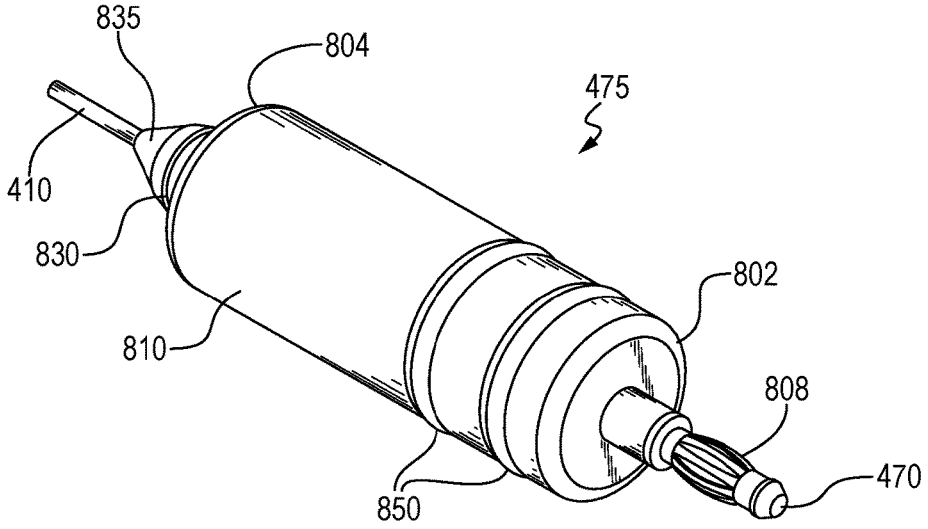
FIG. 4B is a perspective view of the bulkhead and contact pin of FIG. 4A. Here, the view has been rotated relative to the view of FIG. 4A.

FIG. 4B is a perspective view of the contact pin 470 and bulkhead 475. It can be seen that the bulkhead 475 defines a generally tubular body 810. The tubular body 810 has an upstream end 802 and a downstream end 804. O-rings 850 are provided to ensure a seal relative to the surrounding tandem sub 700.

Of interest, the downstream end 804 includes an extended end piece 830. The end piece 830 offers a tip 835 that is over-molded onto the signal transmission line 410. The extended tip 825 secures the signal transmission line 410, preventing the signal transmission line 410 from becoming separated from the contact pin 470 during run-in and operation. Preferably, the signal transmission line 410 is crimped before over-molding to properly secure the signal transmission line 410 to the contact pin 470 and prevent movement during the over-molding process. An opposite end of the contact pin 470 defines a banana clip 808. The banana clip 808 resides within or at least extends well into the tandem sub 700.

As discussed above, it is desirable to transport an assembled (or substantially assembled) perforating gun assembly to a well site without the possibility one of the shaped charges 320 detonating. To address this issue, a novel detonator interrupter assembly is provided herein.

Figure 5A:
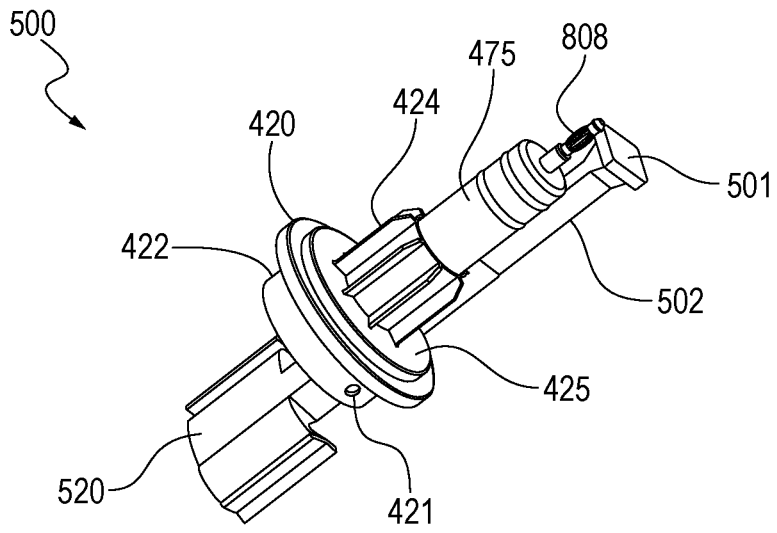
FIG. 5A is a perspective view of the bulkhead of FIG. 4A. Here, the bulkhead has been slidably received within an upstream end of a top end plate. Also visible is the handle portion of a detonator interrupter along with a detonator clip. The components of FIG. 5A may together be referred to as a detonator interrupter assembly.

FIG. 5A is a side view of a detonator interrupter assembly 500 of the present disclosure, in one embodiment. The detonator interrupter assembly 500 is designed to prohibit explosive energy transfer between the detonator (seen at 229 in FIG. 8A) and an explosive detonation cord (shown at 329 in FIGS. 6C and 7B) within a charge tube 310. This, in turn, prevents a gun barrel from "going off" (i.e., detonating) prematurely when the electrical wiring is in place.

Figure 5B:
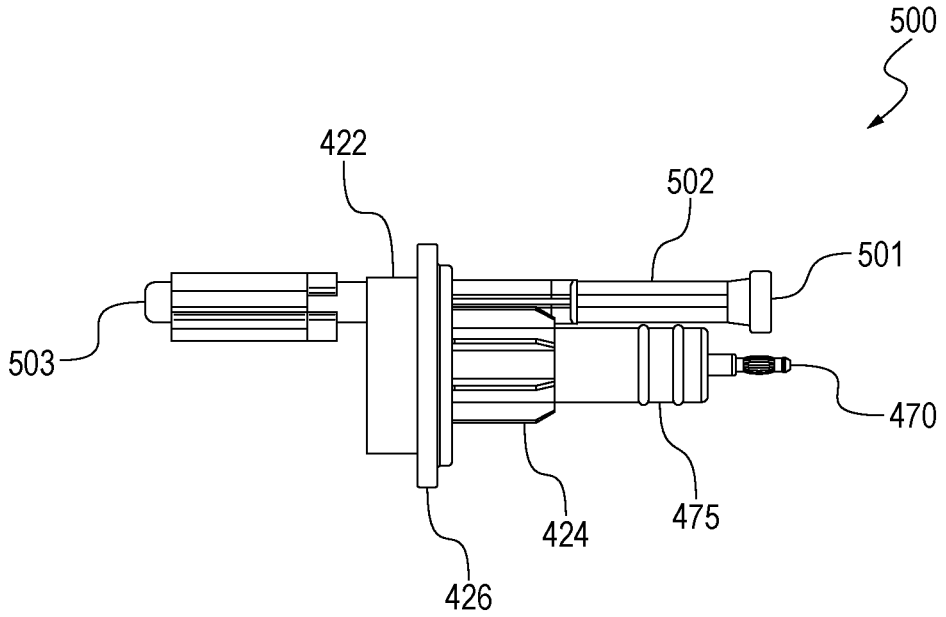
FIG. 5B is a cross-sectional view of the detonator interrupter assembly of FIG. 5A. It is noted that the distal end of the detonator interrupter comprises an elongated blade. The elongated blade slides through the top end plate and between slots of the detonator clip.
Figure 5C:
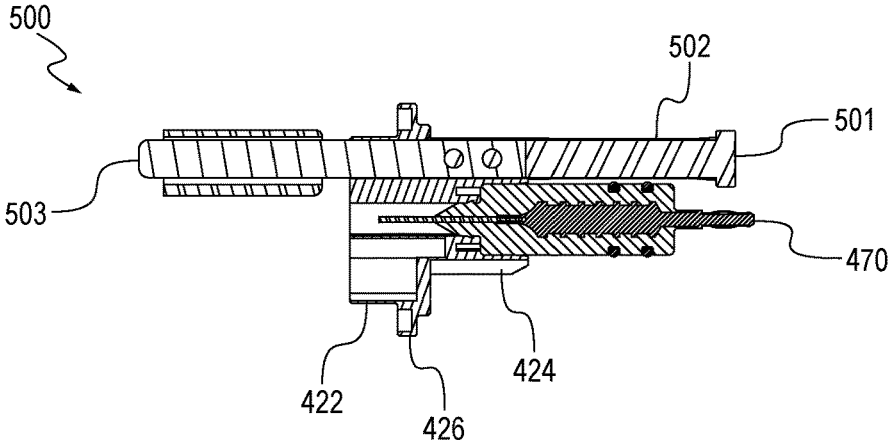
FIG. 5C is a side, cross-sectional view of the detonator interrupter assembly of FIG. 5B. The blade of the sliding detonator interrupter remains between slots of the detonator clip.
Figure 5D:
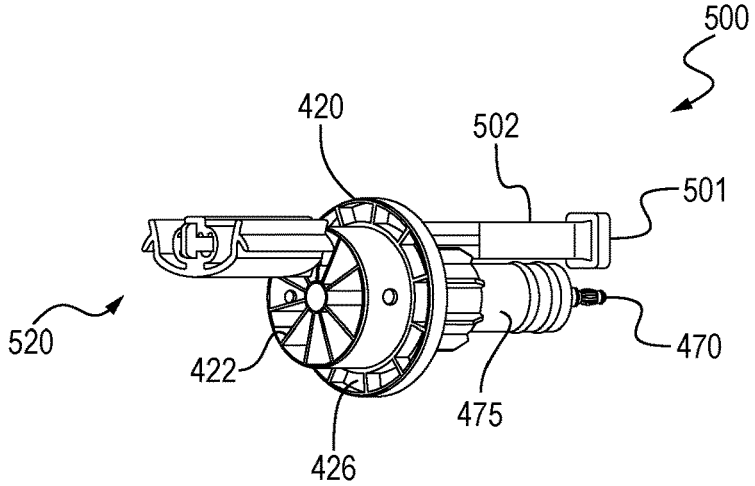
FIG. 5D is a first perspective view of the detonator interrupter assembly of FIG. 5C. The view is taken from an upstream end of the top end plate.
Figure 5E:
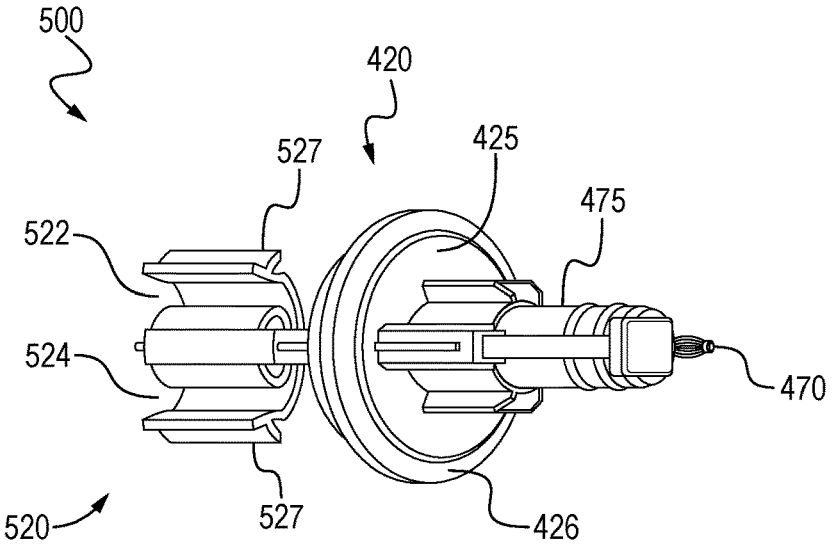
FIG. 5E is second perspective view of the detonator interrupter assembly of FIG. 5A, taken from an angle that is downstream from the top end plate.

FIG. 5B is a side view of the detonator interrupter assembly 500 of FIG. 5A. FIG. 5C is a cross-sectional view of the detonator interrupter assembly 500 of FIG. 5A. FIG. 5D is a first perspective view of the detonator interrupter assembly 500 of FIG. 5A. FIG. 5E is a second perspective view of the detonator interrupter assembly 500 of FIG. 5A. The detonator interrupter assembly 500 will be described with reference to FIGS. 5A through 5E, together.

The detonator interrupter assembly 500 first includes an end plate. In the arrangement of FIGS. 5A through 5E, the end plate is a top end plate. The top end plate sits at an upstream end of a charge tube 300. The end plate may be, for example, the top end plate 420 provided in FIG. 3A. More preferably, the end plate 420 is modified to include an opening that receives a sliding detonator interrupter 502.).

The proximal (or upstream) end 424 of the end plate 420 receives the bulkhead 475 of FIG. 4B. The bulkhead 475, in turn, holds the contact pin 470. The distal end (or contact head) 472 of the contact pin 470 is visible in these views.

The detonator interrupter assembly 500 also comprises a detonator clip 520. The detonator clip 520 comprises a thermoplastically molded piece having two slots 522, 524. A first slot 522 holds an explosive detonator 229, while a second slot 524 holds the proximal end of a detonator cord 329. Both the detonator 229 and the detonator cord 329 reside within the tubular body 310 of the charge tube 300. The detonator cord 329 carries an explosive material from the detonator 229 to each of the shaped charges 320.

The detonator interrupter assembly 500 also includes the detonator interrupter 502. The detonator interrupter 502 represents an elongated tool that slides through the flange 426 of the top end plate 420. The detonator interrupter 502 has a proximal end 501 that represents a handle portion. Of interest, the handle portion 501 resides adjacent the bulkhead 475 and contact pin 470. The detonator interrupter 502 also has a distal end that comprises a thin blade, or blade portion 503.

In one aspect, the handle portion 501 is fabricated from a plastic material that has been injection molded. The handle portion 501 may be about 3 inches in length. At the same time, the blade portion 503 is fabricated from steel or other more inflexible material. The blade portion 503 may also be about 3 inches in length. The blade portion 503 is mechanically connected to the handle portion 501.

With specific reference to FIGS. 5B and 5C, it can be seen that the blade portion 503 of the detonator interrupter 502 has been slidably received between the slots 522, 524 of the detonator clip 520. The thermoplastically formed material of the detonator clip 520 is fabricated such that the two slots 522, 524 are biased inward towards each other. In this way, the blade portion 503 is pinched between the slots 522, 524, and held in place during transport. This may be referred to as the "run-in" position.

It is noted in FIG. 5E that the detonator clip 520 comprises a pair of opposing wings 527. One wing 527 resides proximate slot 522, while the other wing 527 resides proximate slot 524. The wings 527 are designed to plug, snap, or otherwise removably couple into an opening, or window 535, formed within the tubular body 310 of the charge tube 300.

Figure 6A:
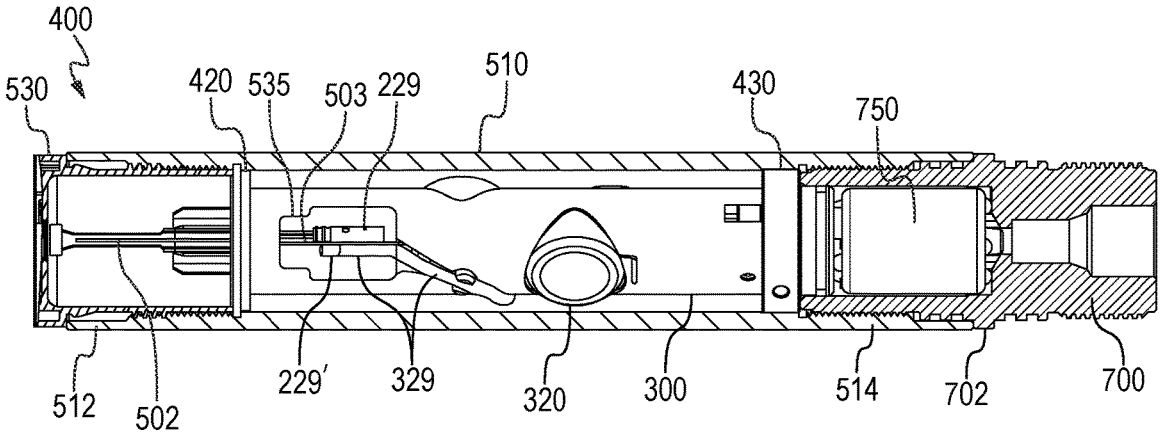
FIG. 6A is a cross-sectional view of a portion of a perforating gun assembly, in one embodiment, having the detonator interrupter assembly of FIGS. 5A through 5E.

FIG. 6A is a first cross-sectional view of a portion of a perforating gun assembly 400, in one embodiment. The perforating gun assembly 400 of FIG. 6A is intended to duplicate the perforating gun assembly 400 of FIGS. 2A through 2C. In this arrangement, the perforating gun assembly 400 includes the detonator interrupter assembly 500 of FIGS. 5A through 5E.

Figure 6B:
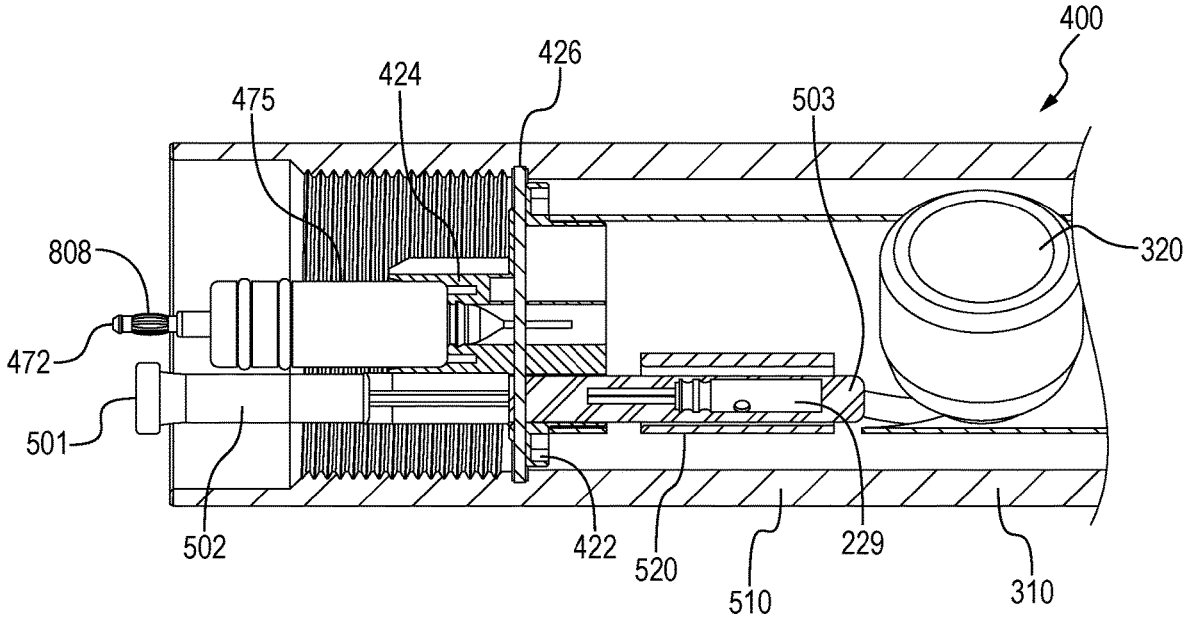
FIG. 6B is an enlarged cut-away view of a portion of a perforating gun assembly, having the detonator interrupter assembly of FIGS. 5A and 5E.
Figure 6C:
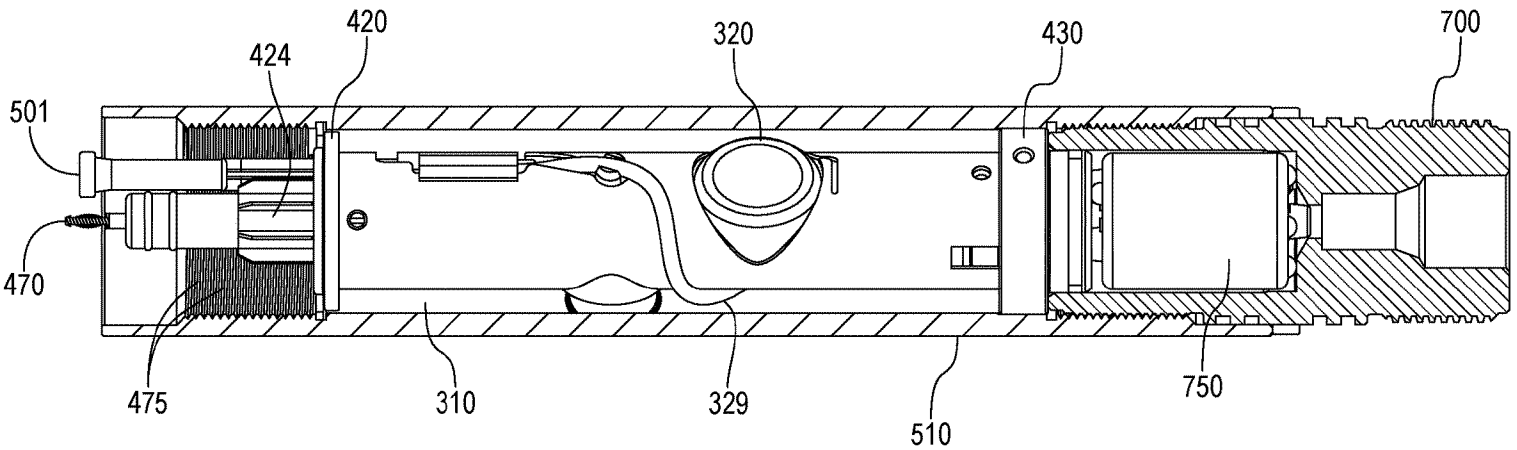
FIG. 6C is a cutaway view of a portion of the perforating gun assembly of FIG. 6A. The detonator interrupter assembly of FIGS. 5A and 5E is partially shown.
Figure 6D:
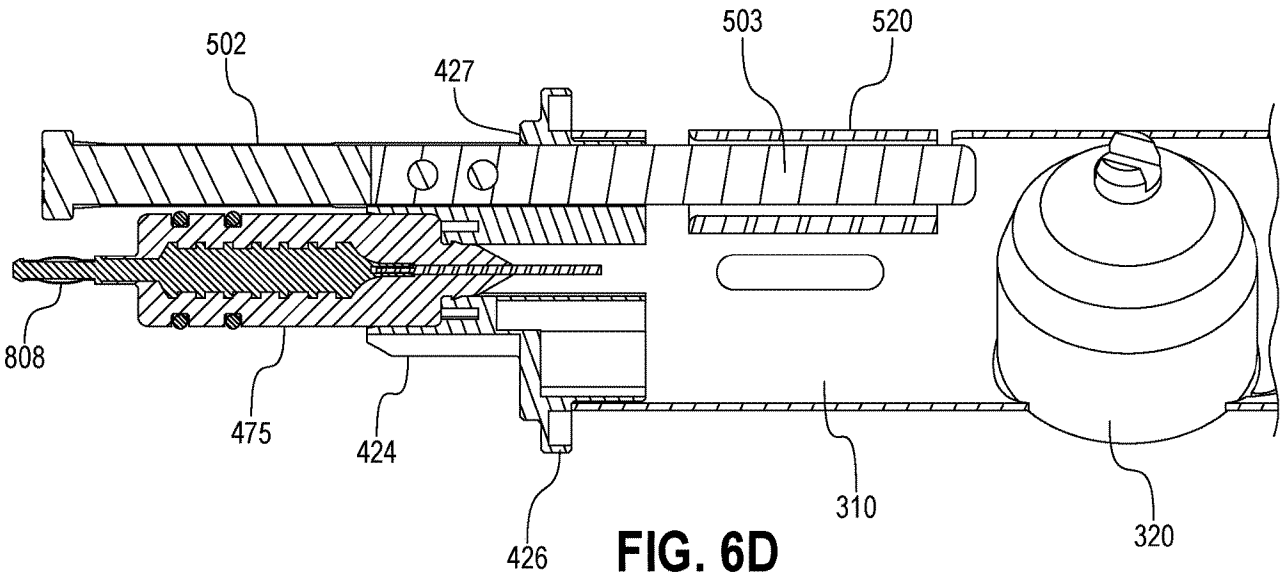
FIG. 6D is another cutaway view of a portion of the perforating gun assembly, having the detonator interrupter assembly of FIGS. 5A and 5E. Here, the blade portion of the detonator interrupter is fully visible.

FIG. 6B is an enlarged, cross-sectional view of a portion of the perforating gun assembly 400 of FIG. 6A. FIG. 6C is a cutaway view of a portion of the perforating gun assembly 400. FIG. 6D is another cutaway view of a portion of the perforating gun assembly 400. Each assembly 400 of FIGS. 6B, 6C and 6D has the detonator interrupter assembly 500 of FIGS. 5A and 5E. The perforating gun assembly 400 will be further described with reference to FIGS. 6A through 6D together.

It is first seen that the perforating gun assembly 400 includes the top end plate 420 and the bottom end plate 430. The charge tube 300 resides between the top end plate 420 and the bottom end plate 430. The perforating gun assembly 400 also includes the outer gun barrel 510. The outer gun barrel 510 passes over each of the top 420 and bottom 430 end plates, serving as a housing. Of interest, the top end plate 420 and the bottom end plate 430 keep the charge tube 300 in a concentric state within the outer gun barrel 510.

The outer gun barrel 510 has an upstream end 512 and a downstream end 514. The upstream end 512 passes over the top end plate 420, while the downstream end 514 encapsulates the bottom end plate 430. The upstream end 512 of the perforating gun assembly 400 has a thread protector 530. The thread protector 530 is screwed onto the threads of the outer gun barrel 510 at the upstream end 512. The thread protector 530 will be removed once the perforating gun assembly 400 is delivered to the well site. The thread protector 530 not only protects the threads, but also protects the run-in position of the detonator interrupter 502.

As noted above, a window 535 is provided along the gun barrel 510. The window 535 exposes a detonator cord 329 and an adjacent detonator 229. A non-explosive detonating cord seal 229' is also visible. Also seen along the outer gun barrel 510 is a single shaped charge 320. It is understood that the perforating gun assembly 400 may, and likely will, have several shaped charges 320 along its length.

At the downstream end 514 of the outer gun barrel 510 is a tandem sub 700. The tandem sub 700 represents a small, tubular body that houses electronics for the perforating gun assembly 400. The electronics include a switch housing 750. Residing within the switch housing 750 is an addressable switch. The addressable switch is seen at 760 of FIG. 10A in the parent patent application.

Also shown is the bulkhead 475. The bulkhead 475 extends out from the top end plate 420 in an upstream direction. As noted in connection with FIGS. 4A and 4B, the bulkhead 475 holds the contact pin 470. The contact pin 470 includes a contact head 472 that connects to the signal transmission line 410. A banana clip 808 facilitates the electrical connection between the contact pin 470 and the signal transmission line 410.

Running adjacent to the bulkhead 475 is the detonator interrupter 502. The proximal end of the detonator interrupter 502 serves as the handle portion 501, while the distal end of the detonator interrupter 502 serves as the blade portion 503. In the views of FIGS. 6A through 6D, the detonator interrupter 502 is in its run-in position. Manually pulling the detonator interrupter 502 will remove the blade portion 503 from between the slots 522, 524, allowing energy (or, more accurately, explosive) transfer between the detonator 229 and the detonator cord 329.

Figure 7A:
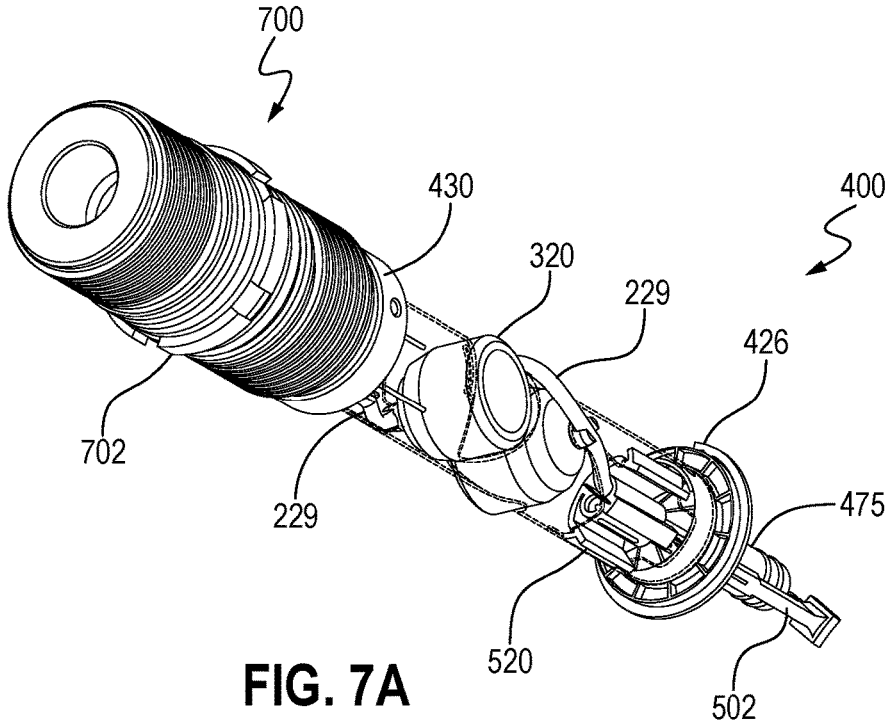
FIG. 7A is a perspective view of a portion of a perforating gun assembly having a detonator interrupter assembly of FIGS. 6A through 6D. The tandem sub is visible, connected to a downstream end plate.

FIG. 7A is a perspective view of a portion of the perforating gun assembly 400 of FIGS. 6A through 6D. Here, the tandem sub 700 is prominently seen. Note that in operation, the tandem sub 700 is at the downstream end of the charges 320 and contact pin 470. Thus, the view is "backwards" for illustrative purposes. (FIG. 6C shows the correct orientation, recognizing that in oil patch parlance the left side of a wellbore or a tool is the upstream side.)

Figure 7B:
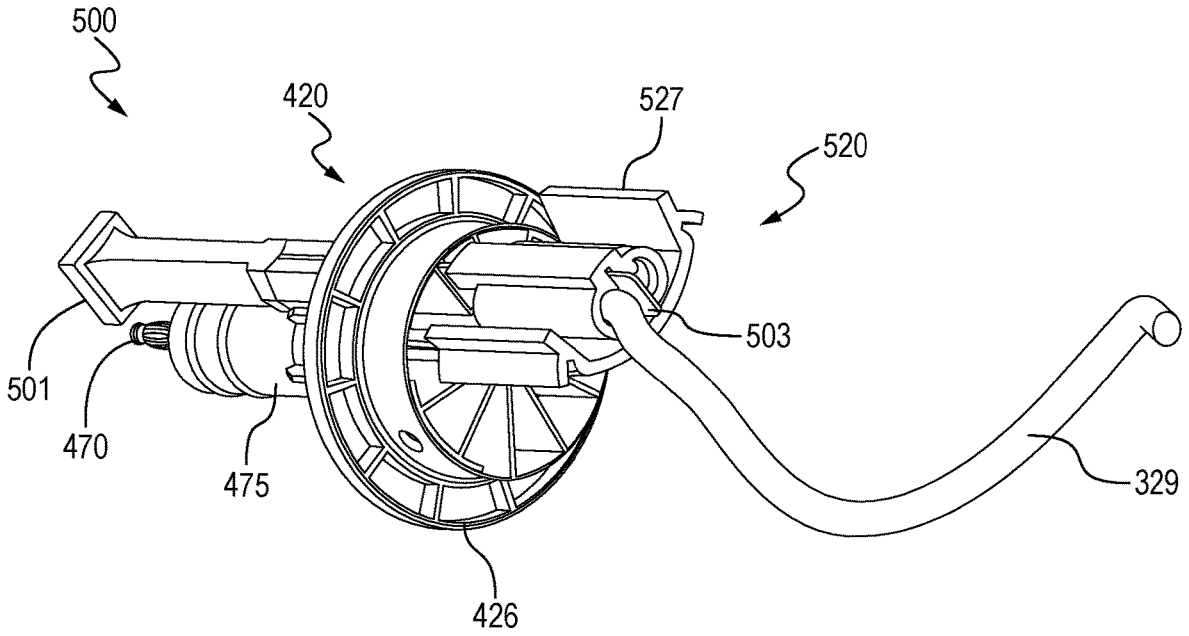
FIG. 7B is a perspective view of the detonator interrupter assembly used in the perforating gun assembly of FIG. 7A. Here, the charge tube and connected tandem sub have been removed. A detonator cord is seen extending from one of the slots of the detonator clip.

FIG. 7B is a perspective view of the detonator interrupter assembly 500 used in the perforating gun assembly 400 of FIG. 7A. Here, the charge tube 300 and connected tandem sub 700 have been removed for illustrative purposes. The detonator cord 329 is seen extending from one of the slots of the detonator clip 522 (shown in FIGS. 5E, 10A, and 10B).

Figure 7C:
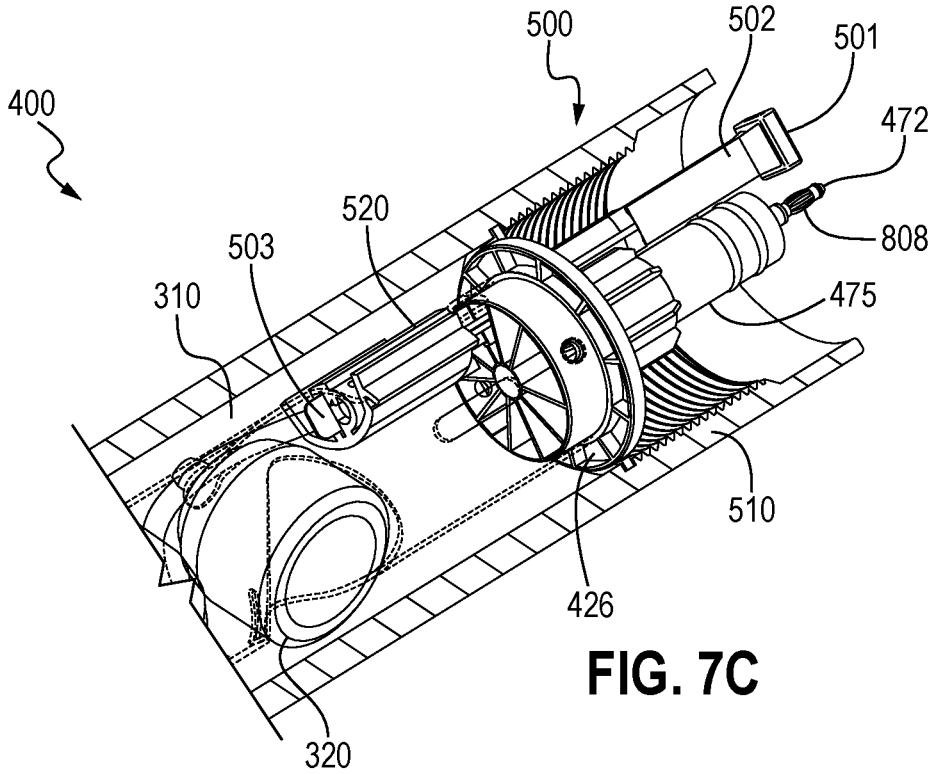
FIG. 7C is a perspective, cutaway view of the detonator interrupter assembly used in the perforating gun assembly of FIG. 7A. The detonator interrupter is seen extending between slots in the detonator clip.

FIG. 7C is a first cutaway view of a portion of the perforating gun assembly 400 of FIGS. 6A through 6D. The detonator interrupter assembly 500 of FIGS. 5A through 5D is also seen.

Figure 7D:
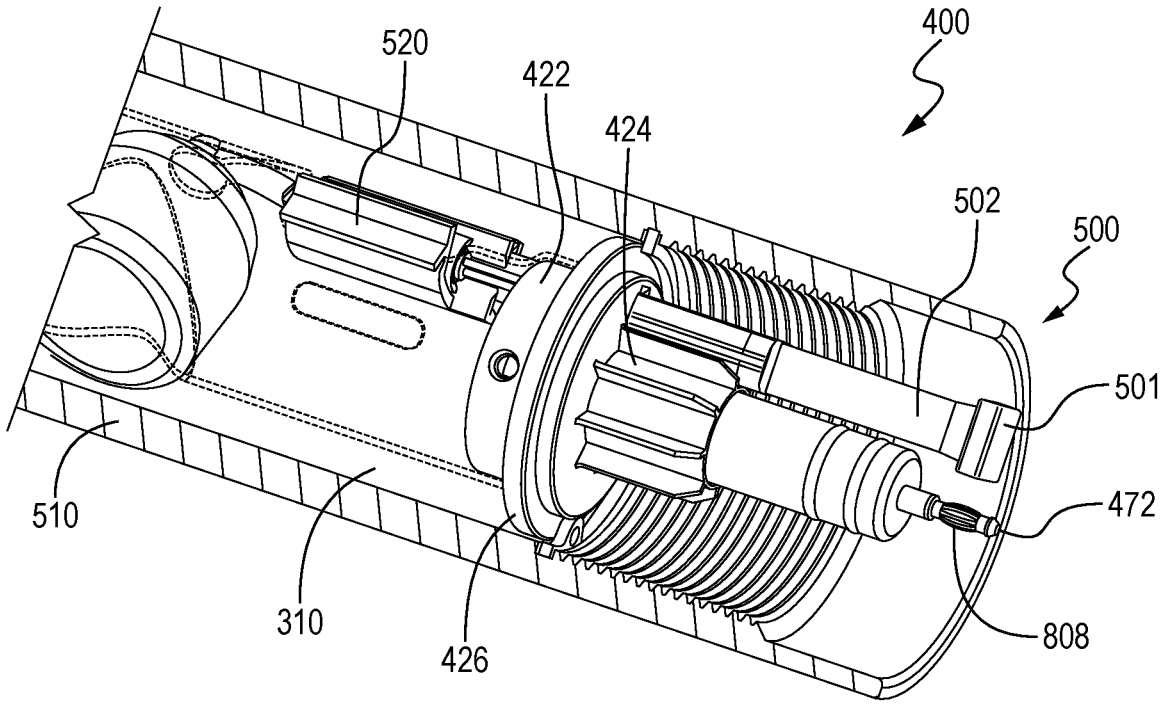
FIG. 7D is another perspective, cutaway view of the detonator interrupter assembly used in the perforating gun assembly of FIG. 7A. The detonator interrupter is again seen extending between slots in the detonator clip.

FIG. 7D is a second cutaway view of a portion of the perforating gun assembly 400 of FIGS. 6A through 6D. The detonator interrupter assembly 500 of FIGS. 5A through 5D is again seen. The handle portion 501 of the detonator interrupter 502 is prominently seen.

Figure 8A:
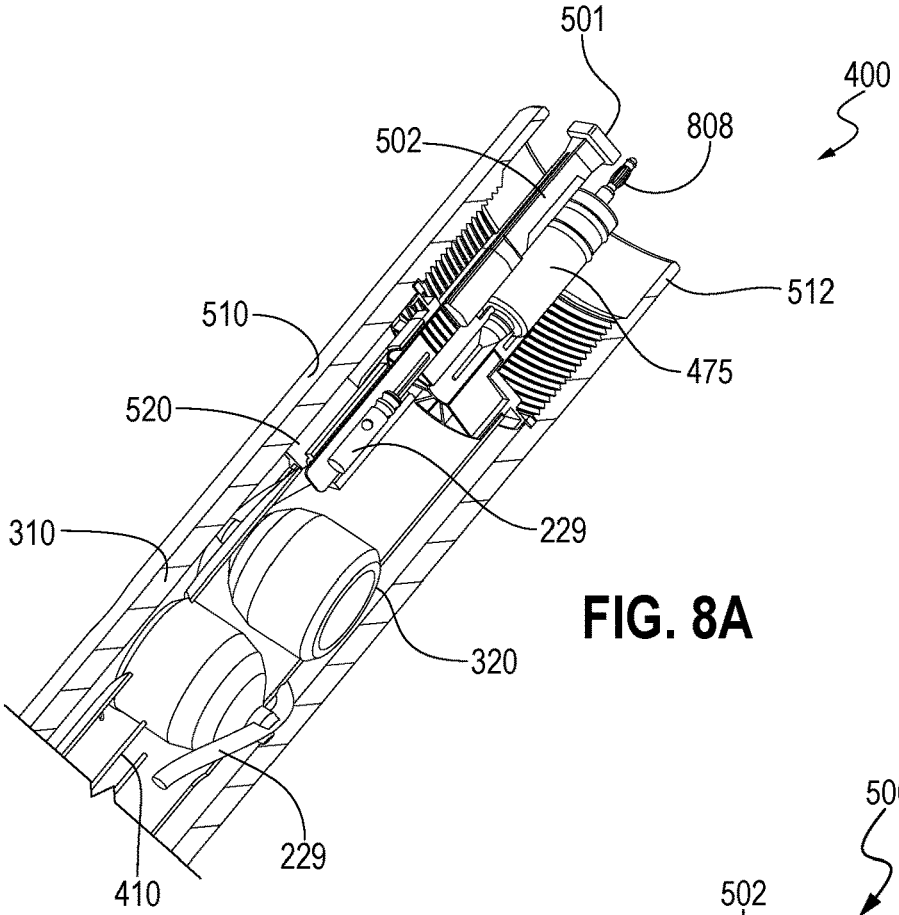
FIG. 8A is a first cutaway view of a portion of the perforating gun assembly of FIGS. 7A through 7D. The detonator interrupter assembly of FIGS. 5A through 5D is seen.

FIG. 8A is a first cutaway view of a portion of the perforating gun assembly 400 of FIGS. 6A through 6D. The detonator interrupter assembly 500 of FIGS. 5A through 5D is again seen.

Figure 8B:
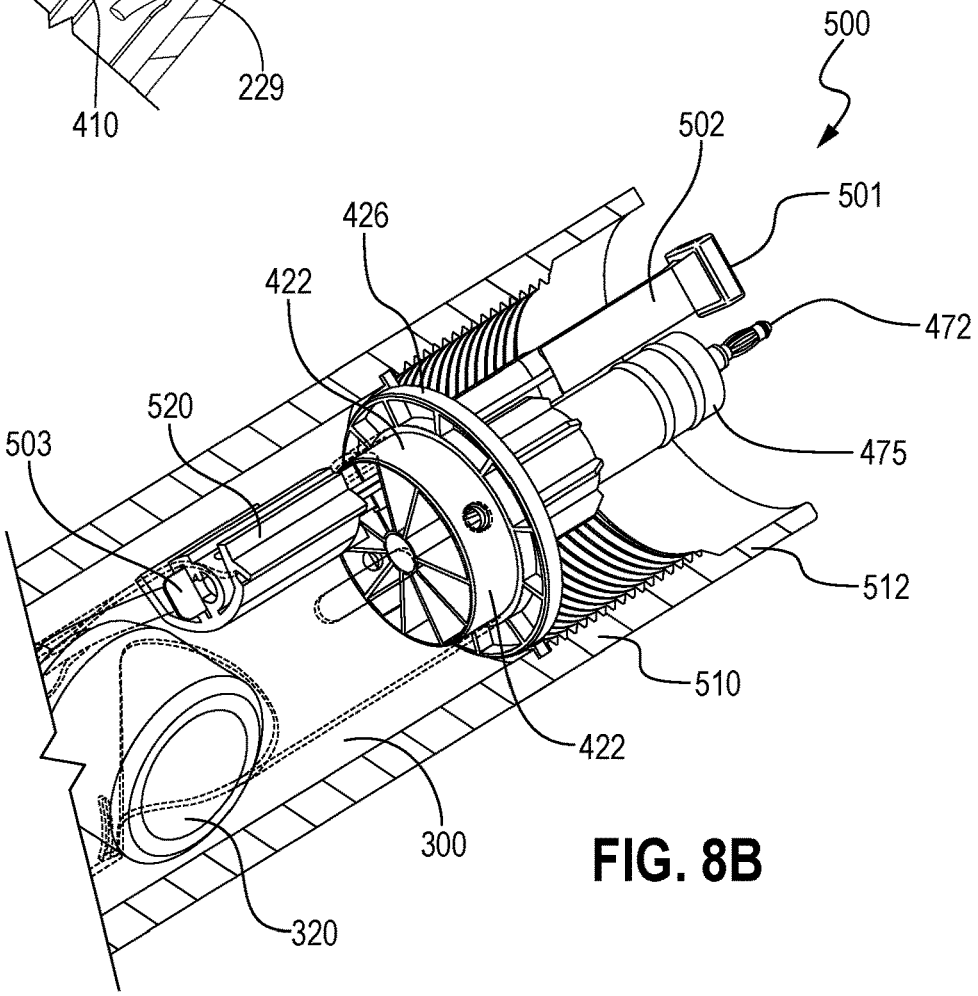
FIG. 8B is a second cutaway view of a portion of the perforating gun assembly of FIGS. 7A through 7D. The detonator interrupter assembly of FIGS. 5A through 5D is again seen.

FIG. 8B is a second cutaway view of a portion of the perforating gun assembly 400 of FIGS. 6A through 6D. The detonator interrupter assembly 500 of FIGS. 5A through 5D is again seen. The blade portion 503 of the detonator interrupter 502 can be seen extending out of the detonator clip 520.

Figure 8C:
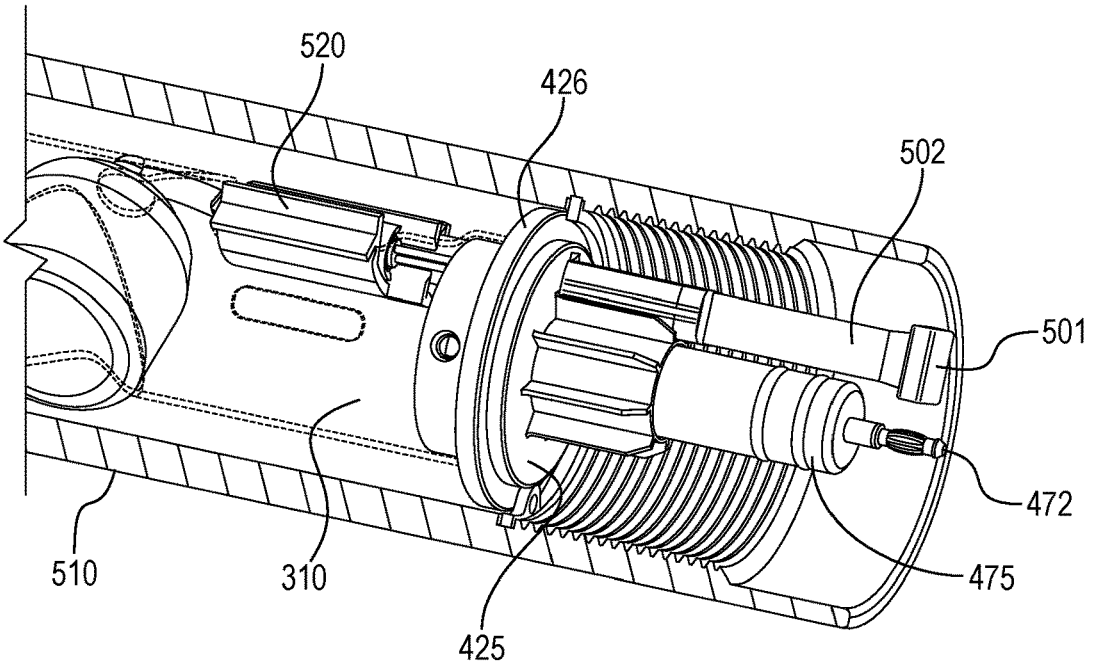
FIG. 8C is a third cutaway view of a portion of the perforating gun assembly of FIGS. 7A through 7D. The detonator interrupter assembly of FIGS. 5A through 5D is again seen.

FIG. 8C is a third cutaway view of a portion of the perforating gun assembly 400 of FIGS. 6A through 6D. The detonator interrupter assembly 500 of FIGS. 5A through 5D is again seen. The relative position of the bulkhead 475 and the handle portion 501 is well-visible.

Figure 9:
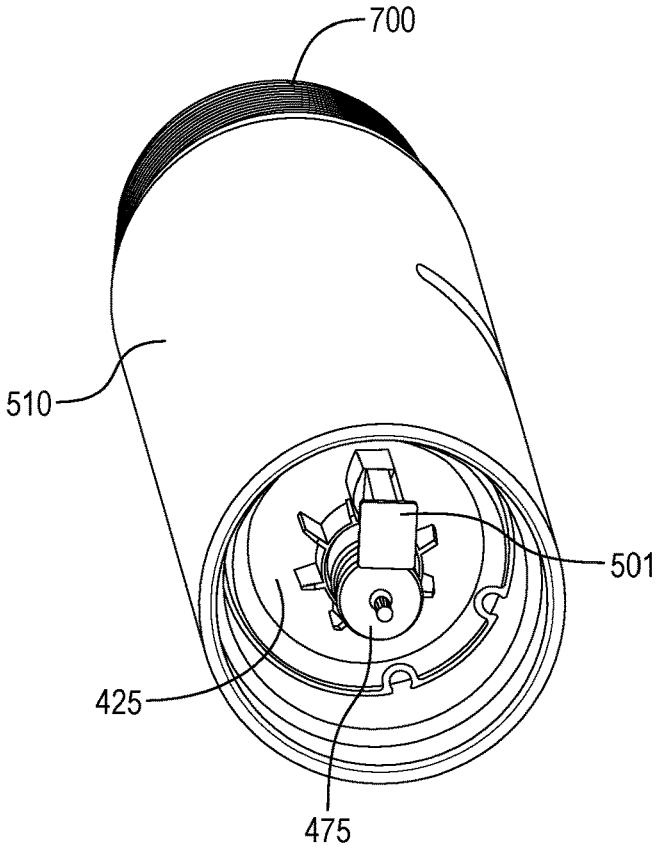
FIG. 9 is a perspective view of a gun barrel housing of a perforating gun assembly. The handle portion of the detonator interrupter from FIG. 7B is visible.

FIG. 9 is a perspective view of the gun barrel housing 510 of the perforating gun assembly 400 of FIG. 8A. The handle portion 501 of the detonator interrupter 502 is visible.

FIG. 10A is a first perspective view of a detonator clip 520 as may be used with the detonator interrupter assembly 500 of the present invention, in one embodiment.

Figure 10B:
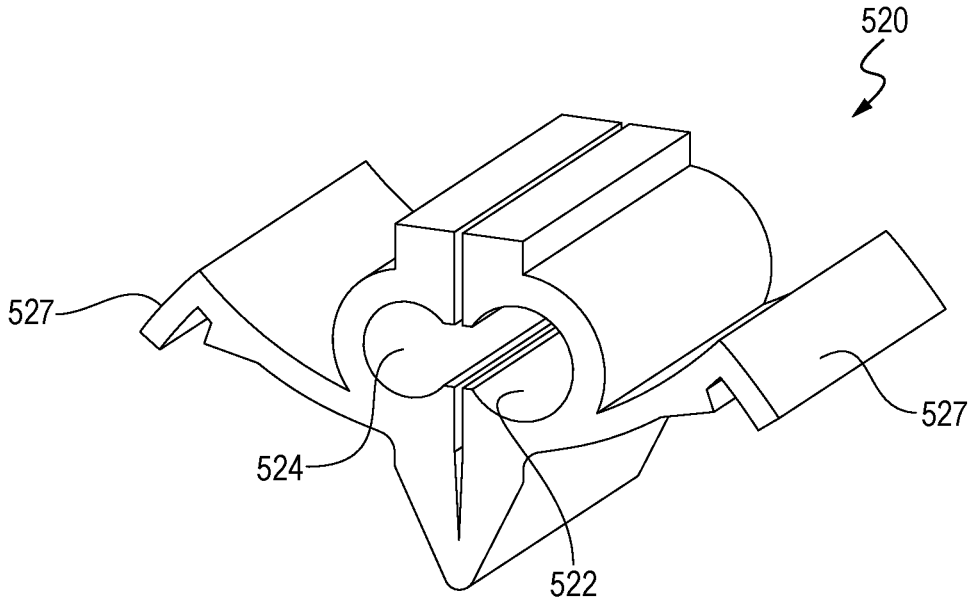
FIG. 10B is a second perspective view of the detonator clip of FIG. 10A.

FIG. 10B is a second perspective view of the detonator clip 520 of FIG. 10A.

In operation, a plurality of perforating guns are assembled at a manufacturing facility or field office. The process for assembling each individual gun includes;

- placing the addressable switch 760 within the switch housing 750;
- securing the switch housing 750 (with the addressable switch 760) within a tandem sub 700;
- connecting the signal transmission line 410 to the signal transmission pin 720';
- electrically connecting the signal transmission pin 720' to the addressable switch (shown at 760 in FIG. 10A of the parent application);
- electrically connecting the addressable switch 760 to the detonator pin 720";
- electrically connecting the detonator pin 720" to the detonator 229 using detonator wire (shown at 540 in FIG. 10A in the parent application);
- placing the detonator 229 into slot 522 of the detonator clip 520;
- placing the detonator cord 329 into slot 524 of the detonator clip 520;
- securing the detonator clip 520 along the tubular body 310 of a charge tube 300;
- electrically connecting the signal transmission pin 720' to the contact head 472;
- sliding the detonator interrupter 502 through the opening of the top end plate 420 such that the blade portion 503 of the detonator interrupter 502 is moved between slots 522, 524 in the detonator clip 520.
- mechanically connecting an upstream charge tube 300 to a bottom end plate 430 (or abutting the upstream charge tube to the bottom end plate 430) at the upstream end of the bottom end plate 430; and
- mechanically connecting a downstream charge tube 300 to a top end plate 420 (or abutting the downstream charge tube to the top end plate 420 and then securing using a bolt) at the downstream end of the top end plate 420.

When it is time to conduct wireline perforating operations, multiple assembled perforating guns are delivered to a well site. Thereafter, threaded connections are made of the pre-assembled perforating guns to form an elongated perforating gun string 200.

Before the perforating gun string 200 is run into the wellbore, the operator will access the windows 535 provided in the charge tubes 300 in order to remove the various detonator interrupters 502. The operator will manually access the handle portions 501 of the detonator interrupters 502, and then pull the handle portions 501 to remove the blade portions 503 from the detonator clips 520. The operator will also remove the thread protectors 530. Thereafter, the following steps are taken:

- sliding the gun barrel housings 510 over the upstream and downstream charge tube bodies 310;
- threadedly connecting the gun barrel housings 510 to respective opposing ends of the tandem sub 700 to form the elongated perforating gun string 200 (note that an upstream end of the tandem sub 700 abuts a downstream end of a bottom end plate 430 (shown in FIG. 6C) while the downstream end of the tandem sub 700 abuts an upstream end of a top end plate 420 (shown in FIG. 10A of the parent application)); and
- run the perforating gun string into the wellbore at the end of an electric line 240.

Once the perforating gun string 200 has been pumped down to the desired depth within the wellbore, a detonation signal is sent from the surface through the electric line 240. The signal reaches the perforating gun assembly 400 (including multiple perforating guns as shown in FIG. 2). Typically, a lowest perforating gun is designated for first explosive initiation. In that case, the signal passes along the internal signal transmission line 410 through each perforating gun 210 and is then passed along by the applicant's novel transmission pins 720', the addressable switch 760 in each tandem sub 700, and the contact pins 470 until the signal reaches a lowest tandem sub 700 and its respective addressable switch 760. The addressable switch 760 then sends a detonation signal back up through the detonator pin 720", through a short detonator wire 540, and to the detonator 229 in the lowest charge tube 300.

In connection with the detonator interrupter assembly 500, and as described in much greater detail in prior applications, to which the current application claims the benefit, a novel detonation system may be employed. The detonation system provides protection for the electronics within the tandem sub 700 during detonation of an upstream (or adjacent) perforating gun. In other words, an upstream perforating gun may be activated without damaging the electronic switch assembly in the tandem sub 700. The addressable switch assembly 760 may be reused for another perforation operation. Similarly, the contact pin 470, the so-called "big" bulkhead 475, and the tandem sub 700 itself are also protected for later re-use in downhole operations.

In one embodiment, the detonation system first includes the tandem sub 700. The tandem sub 700 defines a generally tubular body having a first end and a second end. The first end and the second end each comprise male connectors. This allows the tandem sub 700 to be threadedly connected, in series, to respective perforating gun barrels 500. Thus, the first end is threadedly connected to a first perforating gun (or, more precisely, a female threaded end of a gun barrel), while the second end is threadedly connected to a second perforating gun (or, again, a female threaded end of an opposing gun barrel).

The first (or upstream) end of the tandem sub 700 abuts a first (or bottom) end plate. Similarly, the second opposing (downstream) end of the tandem sub abuts a second (or top) end plate. These may be in accordance with the bottom 430 and top 420 carrier end plates described above. The result is that the bottom and top end plates straddle the tandem sub 700.

An inner bore is formed between the first end and the second end of the tandem sub. An electronic switch housing resides within the inner bore at the first end of the tandem sub. The switch housing holds an addressable switch configured to receive instruction signals from an operator at the surface.

In addition, a receptacle is formed within the inner bore of the tandem sub. The receptacle is dimensioned to closely receive a so-called "big bulkhead." The big bulkhead, shown at 475, comprises:

- a tubular body having a first end, a second end, and a bore extending there between;
- an electrical contact pin 470 having a shaft extending through the bore of the bulkhead body and having an upstream end and a downstream end, wherein the shaft resides within the bore, and wherein the electrical contact pin transmits current from the upstream end to the downstream end; and
- a contact head 472 located at the upstream end of the electrical contact pin 470 outside of the bulkhead body and extending into the switch housing.

The electrical contact pin 470 and its contact head 472 are fabricated substantially from a conductive material such as brass. Of interest, the bulkhead is over-molded over a wire that exits the downstream end of the bulkhead.

The bottom end plate 430 comprises a bore that defines a first opening and a second opening. A signal transmission line 720' extends through the first opening and into the carrier tube 300. Instruction signals are sent through the signal transmission pin 720'. A separate detonator pin 720" extends through the second opening and into the carrier tube 300. The detonator pin 720" is in electrical communication with a detonator 229 residing within the first perforating gun. The detonator 229 is configured to receive activation signals from the addressable switch and ignite an explosive material within a detonating cord 329.

The signal transmission line 410 is connected to the signal transmission pin 720' at the first end of the first bulkhead 610. At the same time, a detonator wire 540 is connected to the detonator pin 720" at the first end of the second bulkhead 620. This may be in accordance with the bulkhead assembly 600 of FIGS. 6A and 6B of the parent application, which uses over-molding to protect the wire connections.

The second end of the signal transmission pin 720' extends from the second end of the first bulkhead 610 and down to a banana clip 618. The banana clip 618 of the signal transmission pin 720' is in electrical communication with the addressable switch 760. Similarly, the second end of the detonator pin 720" extends from the second end of the second bulkhead 620 and also comprises a banana clip 628. Note that the detonator pin 720" is never in electrical communication with the signal transmission line 410 or the signal transmission pin 720'.

All electrical connections for the detonation system described herein may be made at the gun building facility, including the wires connecting the detonator and the addressable switch. The end plate on the gun barrel (or gun carrier) is removed, and the pre-wired electronic switch assembly (that is, the switch housing 750 and encapsulated addressable switch 760) is installed. Beneficially, the bulkheads for the two electrical signal pins 720', 720" associated with the bottom end plate 430 are pre-installed over bulkheads 610, 620 associated with the pins 720', 720" together as part of a novel bridged bulkhead 600.

Using the novel detonator interrupter assembly 500 with the blade portion 503 residing within a detonator clip 520, the detonator 229 may be installed before the perforating gun assembly 400 is sent out. In other words, the detonator 229 may be installed in the shop and still comply with DOT and ATF regulations and API-RP67 recommendations. The detonator interrupter 502 is slid through an opening 427 of the top end plate 420 such that the blade portion 503 of the detonator interrupter 502 is moved between slots 522, 524 in the detonator clip 520.

The bottom end plate 430 is slid against the upstream end 402 of the tandem sub 700. The pre-wired switch assembly can be tested at the gun building facility to reduce the chance of a mis-wired or faulty connection.

Figure 11A:
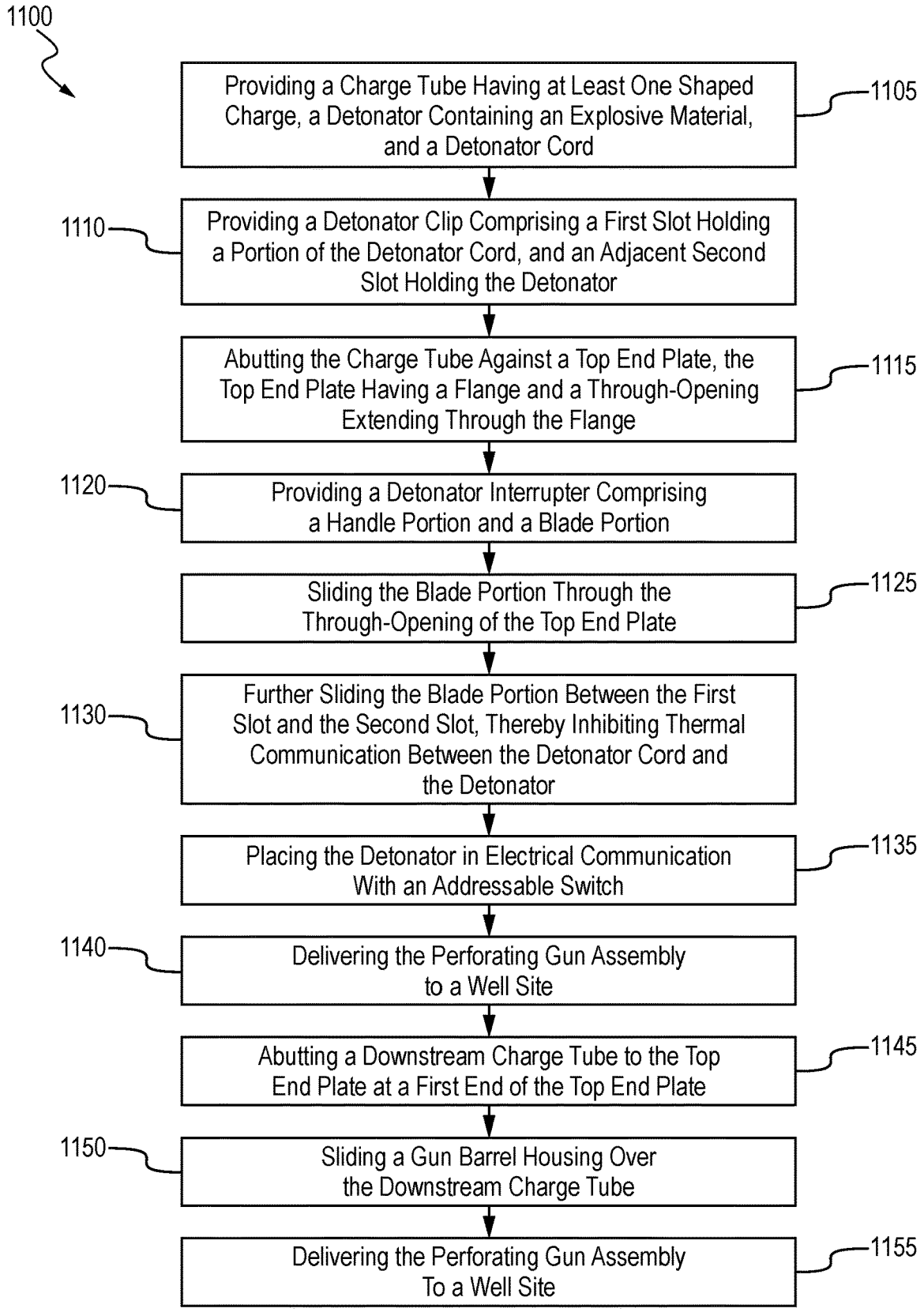
FIGS. 11A and 11B together present a single flow chart. The flow chart shows steps for a method of arming a perforating gun assembly.
Figure 11B:
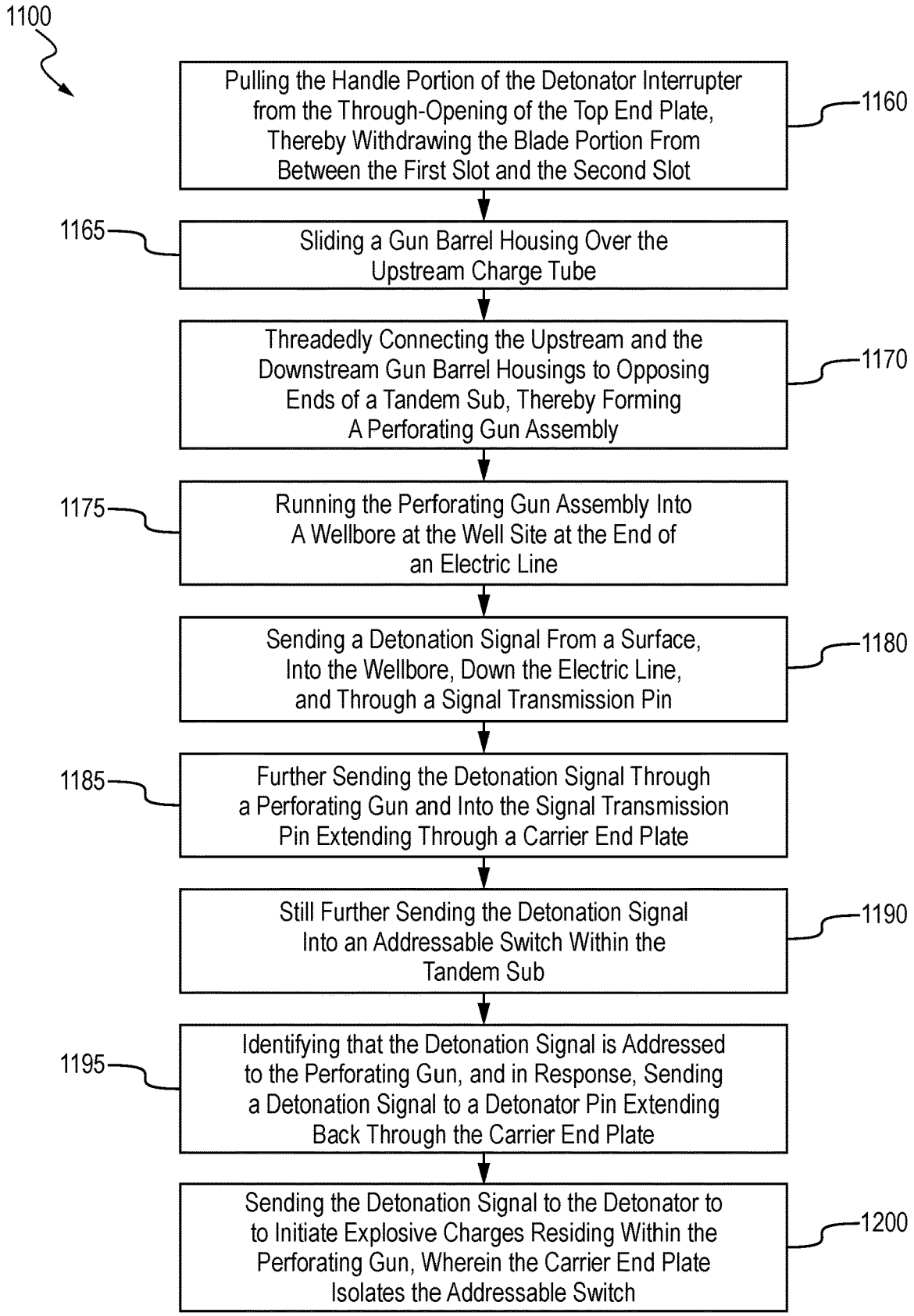

In addition to the explosive initiation assembly discussed above, a method of arming a perforating gun assembly is also provided. The method is demonstrated in the flow chart of FIGS. 11A and 11B, together, and described in steps for a method 1100.

In one aspect, the method 1100 first comprises providing a charge tube. This is seen at Box 1105. The charge tube has at least one shaped charge. In addition, the charge tube holds a detonator containing an explosive material, and a detonator cord. In the method 1100, the charge tube is an upstream charge tube.

The method 1100 also includes providing a detonator clip. This is shown at Box 1110. The detonator clip comprises a first slot holding a portion of the detonator cord, and a second slot holding the detonator. The first and second slots are adjacent to one another. The clip is fabricated from a non-conductive, elastic material that allows the first and second slots to be biased inwards towards each other.

The method 1100 next includes abutting the charge tube against a top end plate. This step is provided at Box 1115. The top end plate comprises a first end, a second end opposite the first end, and a flange intermediate the first and second ends. In addition, the top end plate has a through-opening extending through the flange. The charge tube is abutted against the flange on the downstream side (second end) of the top end plate. For this reason, the charge tube may be referred to as a downstream charge tube.

The method 1100 further comprises providing a detonator interrupter. This is indicated at Box 1120. The detonator interrupter is an elongated object that comprises a handle portion and a blade portion.

In a preferred arrangement, the downstream charge tube comprises a window. At the same time, the detonator clip comprises a pair of wings. The method 1100 may comprise snapping (or otherwise removably coupling) the first wing into a first side of the window, and the second wing into a second side of the window. This serves to secure the detonator clip adjacent the upstream end of the charge tube.

The method 1100 additionally includes sliding the blade portion through the through-opening of the top end plate. This is seen at Box 1125. The blade portion is further moved into a position between the first slot and the second slot of the detonator interrupter. This is shown at Box 1130. This separation of the first and second slots serves to inhibit explosive transfer between the detonator cord and the detonator.

As noted, in the method 1100 the first slot and the second slot are biased towards each other. The blade portion is fabricated from an impact resistant material to inhibit explosive initiation between the detonator and the detonator cord while the blade portion remains between the first and second slots. In addition, the blade portion is configured to pass through the through-opening extending through the flange when an operator removes the interrupter from between the first slot and the second slot.

The charge tube and the detonator interrupter are part of a perforating gun assembly. The perforating gun assembly will include other components such as an addressable switch, a switch housing, and a detonator wire that places the detonator and the addressable switch in electrical communication. The addressable switch and the switch housing reside within a tandem sub upstream from the top end plate.

A separate upstream charge tube abuts the top end plate at the first (or upstream) end of the top end plate. The upstream (or first) end of the top end plate comprises a tubular opening that holds a bulkhead and a contact pin. The contact pin transmits detonation signals through the top end plate and into the downstream charge tube. Of interest, the handle portion 501 of the detonator interrupter 502 runs alongside the bulkhead 475. The method 1100 may further comprise placing the contact pin in the tubular opening, and placing a signal line in electrical communication with the contact pin.

The method may further comprise:

placing the detonator in electrical communication with the addressable switch (Box 1135) in the tandem sub;

abutting the downstream charge tube to the top end plate at the second (or downstream) end of the top end plate (Box 1140);

sliding a gun barrel housing over the downstream charge tube (Box 1150); and delivering the perforating gun assembly to a well site (Box 1155).

After arrival at the well site, the method 1100 further comprises pulling the handle portion of the detonator interrupter from the through-opening of the top end plate. This is indicated at Box 1160. The step of Box 1160 results in withdrawing the blade portion from between the first slot and the second slot. Because the first and second slots are biased inward towards each other, this results in the slots contacting one another.

The method 1100 also includes sliding a gun barrel housing over an upstream charge tube. This is seen at Box 1165. In this case, upstream means upstream from the top end plate.

In addition, the method 1100 may further comprise:

threadedly connecting the upstream and downstream gun barrel housings to respective opposing ends of the tandem sub, thereby forming a perforating gun assembly (Box 1170); and running the perforating gun assembly into a wellbore at the well site, at the end of an electric line (Box 1175).

The perforating gun utilizes an addressable switch. The addressable switch is configured to monitor instruction signals received through the signal line and the signal transmission pin. Stated another way, the addressable switch filters instruction signals from the operator at the surface. Thus, the method 1100 further includes sending the detonation signal through a perforating gun and into the signal transmission pin extending through the top end plate. This is indicated at Box 1180.

When an addressable switch receives a signal associated with its tandem sub and perforating gun, the switch is armed and a window of time is opened (typically about 30 seconds) in which to send a detonation signal from the surface. This is provided at Box 1185. Upon receiving confirmation, the addressable switch will send a detonation signal through a detonation pin residing in the top end plate, and back up to the detonator. The detonator, in turn, ignites the explosive material that passes through the detonating cord and on to the charges along the upstream charge tube. This is shown at Box 1190. The result is that the top end plate isolates the addressable switch from wellbore fluids and the pressure wave generated by detonation of the upstream charges.

If the instruction signal is not recognized as a detonation signal for that tandem sub, the signal is sent on through a contact head residing inside of the switch housing associated with a contact pin. The contact pin resides within a bulkhead. From there, the signal is sent through the contact pin, through a bottom end plate, and on to the downstream perforating gun with its downstream charge tube.

The disclosed embodiments provide methods and systems for preventing electronics located inside a switch sub from being damaged by detonation of an adjacent perforating gun. It should be understood that this description is not intended to limit the present disclosure; on the contrary, the exemplary embodiments are intended to cover alternatives, modifications, and equivalents, which are included in the spirit and scope of the inventions as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Further, variations of the detonation system and of methods for using the detonation system within a wellbore may fall within the spirit of the claims, below. It will be appreciated that the presently disclosed subject matter is susceptible to other modifications, variations, and changes without departing from the spirit thereof.

I claim:

1. A detonator interrupter assembly, comprising:

a top end plate having a first end, a second end opposite the first end, and a flange intermediate the first and second ends;

a through-opening extending through the flange;

a detonator clip residing proximate the second end of the top end plate, wherein the detonator clip comprises a first slot configured to receive a detonator cord, and a second slot adjacent to the first slot configured to receive a detonator tube containing an explosive material;

an interrupter comprising an elongated handle portion at a first end residing proximate the first end of the top end plate, and a blade portion at a second end residing proximate the second end of the top end plate;

and wherein:

the first slot and the second slot are biased inwardly towards each other;

the blade portion slidably resides between the first slot and the second slot;

the blade portion is fabricated from an impact resistant material to inhibit explosive initiation between the detonator tube and the detonator cord while the blade portion remains between the first slot and the second slot; and the blade portion is configured to pass back through the through-opening extending through the flange when an operator removes the interrupter from between the first slot and the second slot.

2. The detonator interrupter assembly of claim 1, wherein:

the first end of the top end plate comprises a tubular opening configured to receive a contact pin for a perforating gun.

3. The detonator interrupter assembly of claim 2, wherein:

the second end of the top end plate defines a downstream end; and the second end of the top end plate abuts a downstream charge tube for a perforating gun.

4. The detonator interrupter assembly of claim 3, wherein:

the downstream charge tube comprises a window;

the detonator clip comprises a pair of wings, with a first wing residing adjacent the first slot, and the second wing residing adjacent the second slot, and the first wing and second wing removably couple into opposing sides of the window.

5. The detonator interrupter assembly of claim 4, wherein:

the detonator clip is fabricated from a polymeric material.

6. The detonator interrupter assembly of claim 5, wherein:

the handle portion of the interrupter is also fabricated from a polymeric material; and the blade portion of the interrupter is fabricated from a metal.

7. The detonator interrupter assembly of claim 6, wherein:

the first slot holds the detonator cord; and the second slot receives the detonator tube containing the explosive material.

8. The detonator interrupter assembly of claim 3, wherein:

the tubular opening at the first end of the top end plate is configured to receive a bulkhead;

and wherein:

the bulkhead receives the contact pin;

the contact pin has an upstream end and a downstream end; and the upstream end of the contact pin extends into a tandem sub for the perforating gun.

9. The detonator interrupter assembly of claim 8, wherein:

the handle portion of the interrupter is adjacent to and runs parallel with the bulkhead.

10. A method of arming a perforating gun assembly, comprising:

providing a charge tube having at least one shaped charge, a detonator containing an explosive material, and a detonator cord;

providing a detonator clip, wherein the detonator clip comprises a first slot holding a portion of the detonator cord, and a second slot adjacent the first slot holding the detonator;

abutting the charge tube against a top end plate, wherein the top end plate comprises a first end, a second end opposite the first end, a flange intermediate the first and second ends, and a through-opening extending through the flange;

providing a detonator interrupter assembly, wherein the detonator interrupter assembly comprises a detonator interrupter having a handle portion and a blade portion; and sliding the blade portion through the through-opening of the flange and between the first slot and the second slot, thereby inhibiting explosive initiation between the detonator and the detonator cord;

wherein the charge tube and detonator interrupter assembly are part of the perforating gun assembly.

11. The method of claim 10, wherein:

the first slot and the second slot are biased inwardly towards each other;

the second end of the top end plate is a downstream end;

the charge tube abuts the top end plate at the second end of the top end plate;

the blade portion is fabricated from an impact resistant material to inhibit explosive initiation between the detonator and the detonator cord while the blade portion remains between the first and second slots; and the blade portion is configured to pass through the through-opening extending through the flange when an operator removes the detonator interrupter from between the first slot and the second slot.

12. The method of claim 11, wherein:

the charge tube is a downstream charge tube, abutting the second end of the top end plate;

the first end of the top end plate comprises a tubular opening;

and the method further comprises placing a contact pin in the tubular opening, and connecting a signal wire to the contact pin.

13. The method of claim 12, wherein:

the charge tube comprises a window;

the detonator clip comprises a pair of wings; and the method further comprises removably coupling the first wing into a first side of the window, and the second wing into a second side of the window, thereby securing the detonator clip adjacent the second side of the top end plate.

14. The method of claim 13, wherein:

the detonator clip is fabricated from a polymeric material; the handle portion of the detonator interrupter is also fabricated from a polymeric material; and the blade portion of the detonator interrupter is fabricated from a metal.

15. The method of claim 13, further comprising:

placing the detonator in electrical communication with an addressable switch; and delivering the perforating gun assembly to a well site.

16. The method of claim 15, further comprising:

abutting an upstream charge tube to the first end of the top end plate;

after arrival at the well site, pulling the handle portion of the detonator interrupter from the through-opening of the top end plate, thereby withdrawing the blade portion from between the first slot and the second slot; and sliding an upstream gun barrel housing over the upstream charge tube.

17. The method of claim 16, further comprising:

sliding a gun barrel housing over the downstream charge tube; and threadedly connecting the upstream and downstream gun barrel housings to respective opposing ends of a tandem sub, thereby forming the perforating gun assembly.

18. The method of claim 17, further comprising:

running the perforating gun assembly into a wellbore at the well site, at the end of an electric line;

sending a first detonation signal from a surface, into the wellbore, and down the electric line;

further sending the detonation signal through the perforating gun to a signal transmission pin extending through a carrier end plate;

still further sending the detonation signal into the addressable switch within the tandem sub, wherein the addressable switch determines whether the detonation signal is addressed to the perforating gun;

identifying that the detonation signal is addressed to the perforating gun, and in response, sending a second detonation signal to a detonator pin extending back through the carrier end plate; and sending the second detonation signal to the detonator to initiate at least one explosive charge residing within the perforating gun, wherein the carrier end plate isolates the addressable switch from wellbore fluids and a pressure wave generated in response to the detonation of the explosive charges.

19. The method of claim 12, wherein:

the tubular opening at the first end of the top end plate is configured to receive a bulkhead;

and wherein:

the bulkhead receives the contact pin;

the contact pin has an upstream end and a downstream end; and the upstream end of the contact pin extends into the tandem sub for the perforating gun.

20. The method of claim 19, wherein:

the handle portion of the detonator interrupter is adjacent to and runs parallel with the bulkhead.

* * * * *